US011652325B2

(12) United States Patent
Mongold et al.

(10) Patent No.: US 11,652,325 B2
(45) Date of Patent: May 16, 2023

(54) CABLE CONNECTOR SYSTEM

(71) Applicant: Samtec, Inc., New Albany, IN (US)

(72) Inventors: John A. Mongold, New Albany, IN (US); Jonathan E. Buck, New Albany, IN (US); Jignesh H. Shah, New Albany, IN (US); Chadrick P. Faith, New Albany, IN (US); Randall E. Musser, New Albany, IN (US); Jean Karlo Williams Barnet, New Albany, IN (US); Norman S. McMorrow, New Albany, IN (US)

(73) Assignee: SAMTEC, INC., New Albany, IN (US)

( * ) Notice: Subject to any disclaimer, the term of this patent is extended or adjusted under 35 U.S.C. 154(b) by 0 days.

(21) Appl. No.: 17/950,458

(22) Filed: Sep. 22, 2022

(65) Prior Publication Data

US 2023/0016523 A1 Jan. 19, 2023

Related U.S. Application Data

(63) Continuation of application No. 17/256,763, filed as application No. PCT/US2019/041356 on Jul. 11, 2019.

(60) Provisional application No. 62/840,731, filed on Apr. 30, 2019, provisional application No. 62/813,102, filed on Mar. 3, 2019, provisional application No.

(Continued)

(51) Int. Cl.

| | |
|---|---|
| ***H01R 13/648*** | (2006.01) |
| ***H01R 13/6587*** | (2011.01) |
| ***H01R 12/59*** | (2011.01) |
| ***H01R 12/79*** | (2011.01) |
| ***H01R 13/11*** | (2006.01) |

(52) U.S. Cl.
CPC ..... *H01R 13/6587* (2013.01); *H01R 12/594* (2013.01); *H01R 12/79* (2013.01); *H01R 13/113* (2013.01)

(58) Field of Classification Search
CPC ..... H01R 13/6587; H01R 13/6586; H01R 13/113; H01R 12/59; H01R 12/594; H01R 12/77; H01R 12/79
USPC ..... 439/607.06
See application file for complete search history.

(56) References Cited

U.S. PATENT DOCUMENTS 5,967,846 A 10/1999 Davis et al.
6,544,048 B2 4/2003 Harting et al.
(Continued)

FOREIGN PATENT DOCUMENTS

CN 204760581 U 11/2015
TW 201539868 A 10/2015
(Continued)

OTHER PUBLICATIONS

Mongold et al., "Cable Connector System", U.S. Appl. No. 17/256,763, filed Dec. 29, 2020.

(Continued)

*Primary Examiner* — Khiem M Nguyen
(74) *Attorney, Agent, or Firm* — Keating & Bennett, LLP

(57) ABSTRACT

A cable connector includes a cable including a center conductor and a housing supporting a portion of the center conductor. An imaginary line divides a cross-section of the center conductor into two semicircles, and when the cable connector is mated with a mating connector, only one of the two semicircles is directly connected with a corresponding contact of the mating connector.

22 Claims, 33 Drawing Sheets

Related U.S. Application Data

62/704,052, filed on Jan. 28, 2019, provisional application No. 62/704,025, filed on Oct. 9, 2018, provisional application No. 62/728,278, filed on Sep. 7, 2018, provisional application No. 62/697,014, filed on Jul. 12, 2018.

(56) References Cited

U.S. PATENT DOCUMENTS

| | | | | |
|---|---|---|---|---|
| 10,044,144 | B2 | 8/2018 | Moedinger et al. | |
| 2007/0010124 | A1 | 1/2007 | Ko | |
| 2016/0315419 | A1 | 10/2016 | Regnier et al. | |
| 2018/0006416 | A1 | 1/2018 | Lloyd et al. | |
| 2019/0027870 | A1 | 1/2019 | Lloyd et al. | |
| 2020/0119498 | A1 | 4/2020 | Laurx et al. | |
| 2021/0265785 | A1* | 8/2021 | Mongold ..... | H01R 12/62 |

FOREIGN PATENT DOCUMENTS

| | | | |
|---|---|---|---|
| TW | 201803231 | A | 1/2018 |
| TW | 11625010 | B | 8/2021 |

OTHER PUBLICATIONS

Official Communication issued in corresponding Taiwanese Patent Application No. 111109451, dated Feb. 3, 2023.

* cited by examiner

CABLE CONNECTOR SYSTEM

CROSS REFERENCE TO RELATED APPLICATIONS

This application claims benefit to U.S. Patent Application No. 62/697,014, filed on Jul. 12, 2018; U.S. Patent Application No. 62/728,278, filed on Sep. 7, 2018; U.S. Patent Application No. 62/704,025, filed on Oct. 9, 2018; U.S. Patent Application No. 62/704,052, filed on Jan. 28, 2019; U.S. Patent Application No. 62/813,102, filed on Mar. 3, 2019; and U.S. Patent Application No. 62/840,731, filed Apr. 30, 2019, all of which are incorporated by reference in their entirety for all purposes as if fully set forth herein.

BACKGROUND OF THE INVENTION

1. Field of the Invention

The present invention relates to connector systems. More specifically, the present invention relates to connector systems that facilitate data throughput through a 1 rack unit (RU) panel, where 1 RU is equal to 1.75 inches or 44.45 mm by 19 inches or 482.6 mm, of at least 15 TB/sec.

2. Description of the Related Art

Up to seventy-two SFP+ ports can fit within a 1 RU faceplate area of about 352.75 mm by 41 mm (or 144.6 $cm^2$). Corresponding throughput is 720 Gb/sec. Up to seventy-two zSFP+ ports can fit within the 1 RU faceplate area. Corresponding throughput is 1.8 Tb/sec. Up to thirty-six QSFP28 ports can fit within the 1 RU faceplate area. Corresponding throughput is 3.6 Tb/sec. Up to thirty-six QSFP56 ports can fit within the 1 RU faceplate area. Corresponding throughput is 7.2 Tb/sec. Up to seventy-two microQSFP ports can fit within the 1 RU faceplate area. Corresponding throughput is 14.4 Tb/sec. Up to seventy-two SFP-DD ports can fit within the 1 RU faceplate area. Corresponding throughput is 7.2 Tb/sec. Up to thirty-six QSFP-DD ports can fit within the 1 RU faceplate area. Corresponding throughput is 14.4 Tb/sec.

SUMMARY OF THE INVENTION

The embodiments of the present invention facilitate throughput of at least 15 Tb/sec, at least 20 Tb/sec, at least 25 Tb/sec, at least 30 Tb/sec, at least 35 Tb/sec, at least 37.5 Tb/sec, at least 40 Tb/sec, at least 45 Tb/sec, and at least 50 Tb/sec through various 1 RU faceplate areas. Throughput of 37.5 Tb/sec or 50 Tb/sec is more than double the 14.4 Tb/sec throughput of the prior art.

Various independent embodiments of the present invention can include cable connectors that can connect orthogonally to a mating connector, such as a board connector; board connectors with compression spring ground blades that connect electrically with connector shields of a respective cable connector; connector systems that can each include a board connector and a mating cable connector positioned on both sides of a die package; and first electrical panel connectors that can carry up to or at least thirty-two differential signal pairs but still operate with 0 dB to −0.5 dB of insertion loss through frequencies up to and including 28 GHz, 56G NRZ, and 112G PAM4; operate with return loss under −15 dB through frequencies up to and including 30 GHz, 56G NRZ, and 112G PAM4; or operate with frequency domain near end crosstalk of under −50 dB through frequencies up to and including 30 GHz, 56G NRZ, and 112G PAM 4.

Embodiments of the present invention provide cable connector systems that allow cable connectors to be connected to a board connector in a stacked or nested configuration, while reducing the footprint and stack height required by the board connector. For example, embodiments of the present invention can be used in groups of connectors positioned on one or both opposed surfaces of a die package substrate. Embodiments of the present invention can be used to collectively transmit at least 37.5 terabytes of data per second with frequency domain crosstalk of −40 dB or better on a standard 70-mm-by-70-mm die package. On larger die packages, such as 120-mm-by-120 mm die package, a 145-mm-by-145-mm die package, a 150-mm-by-150-mm die package, or other sized die packages larger than 70-mm-by-70-mm, data throughput can be at least 50 Tb/sec. Embodiments of the present invention can have a height, measured from a mounting surface of the PCB to a top surface of any one of the board connectors described herein of about 1.5 mm to about 6 mm.

According to an embodiment of the present invention, a cable includes a first cable conductor that defines a first mating end, a second cable conductor that defines a second mating end, and an insert that carries the first cable conductor and the second cable conductor. The first mating end defines a first contact surface, the second mating end defines a second contact surface, the first contact surface is configured to electrically connect to a first electrical contact, and the second contact surface is configured to electrically connect to a second electrical contact. The first contact surface and the second contact surface can face in opposite directions.

The first cable conductor and the cable second conductor can define a differential signal pair. The cable connector can further include a dielectric layer that at least partially surrounds the first cable conductor and the second cable conductor. The cable connector can further include a cable shield that at least partially surrounds the dielectric layer.

A first centerline can divide a cross-section of the first mating end of the first cable conductor into a first semicircle and a second semicircle, and the first semicircle can be devoid of plastic and defines the first contact surface. A second centerline can divide a cross-section of the second mating end of the second cable conductor into a third semicircle and a fourth semicircle, and the fourth semicircle can be devoid of plastic and defines the second contact surface.

A first centerline line can divide a cross-section of the first mating end of the first cable conductor into a first semicircle and a second semicircle; a second centerline can divide a cross-section of the second mating end of the second cable conductor into a third semicircle and a fourth semicircle; and the first semicircle can be devoid of plastic, the fourth semicircle can be devoid of plastic, and the second and third semicircles can be positioned between the first semicircle and the fourth semicircle.

A centerline line can divide a cross-section of the first mating end of the first cable conductor into a first semicircle and a second semicircle and a cross-section of the second mating end of the second cable conductor into a third semicircle and a fourth semicircle; and the first semicircle can be devoid of plastic, the third semicircle can be devoid of plastic, the first contact surface can face away from the second semicircle, and the second contact surface can face away from the third semicircle.

The first mating end can be devoid of a cable shield. The second mating end can be devoid of a cable shield. The first contact surface can be only a single contact surface. The second contact surface can be only a single contact surface.

The cable connector can further include a connector shield carried by the insert. The connector shield can define a groove, and the groove can be configured to receive a cable shield. The connector shield can define a slot, and the slot can be configured to receive a ground blade of a mating connector.

The insert can define a tooth. The insert can define a first hole and a second hole adjacent to the base. The tooth can define a base and a cross member positioned perpendicular to the base. The base can define a first base recess adjacent to the first hole, and the first hole and the first base recess can receive the first mating end of the first cable conductor. The base can define a second base recess adjacent to the second hole, and the second hole and the second base recess can receive the second mating end of the second cable conductor.

The first conductor and the second conductor can be part of a shielded, coextruded twin axial cable that can have a gauge of 34 AWG to 36 AWG. The first conductor and the second conductor can be part of a shielded, co-extruded twin axial cable that can have a gauge of 28 AWG to 30 AWG.

The cable connector can be arranged to be nested within a mating connector when mated with the mating connector.

According to an embodiment of the present invention, a cable connector includes a cable; an insert including an insert body that defines holes and a tooth adjacent to the holes, wherein the tooth extends away from the insert body; and a connector shield connected to the insert. A first mating end of a first cable conductor and a second mating end of a second cable conductor extend through respective holes such that the first and second mating ends of the respective first and second cable conductors are supported by the tooth.

The cable can include a cable shield; the connector shield can include grooves; and the cable shield can be connected to a corresponding one of the grooves.

According to an embodiment of the present invention, a board connector includes a board connector housing, a ground plane carried by the board connector housing, and electrical contacts carried by the board connector housing, wherein the electrical contacts electrically contact only one semicircular side of a respective mating cable conductor.

The ground plane can include at least one ground plane arm that extends into a hole in the board connector housing. The ground plane can include at least one slot. The ground plane can include at least one hole.

The board connector can further include a ground blade that electrically connects with the ground plane. The ground blade can include a tail, a leg, and a spring; and the tail can extend through the board connector housing, and the spring can be configured to electrically connect to a cable shield of a mating cable connector.

The ground plane can include ground arms that extend beneath heads of the electrical contacts. The ground plane and the board connector housing can each define a right angle shape. The electrical contacts can be configured to be surface mounted to a substrate.

According to an embodiment of the present invention, a board connector includes a board connector housing including a second connector mating interface that receives a second cable connector and a first connector mating interface that receives a first cable connector that is stacked on top of second cable connector; ground blades that extend into both the first and second connector mating interfaces; and between two of the ground blades that are adjacent to each other, a first pair of electrical contacts that directly contact a respective one of a first cable conductor and a second cable conductor of the first cable connector; and a second pair of electrical contacts that directly contact a respective one of a first cable conductor and a second cable conductor of the second cable connector.

The board connector can further include a first ground plane positioned in the second connector mating interface and a second ground plane positioned in the first connector mating interface.

According to an embodiment of the present invention, a cable connector system includes a board connector, a first cable connector including a first insert connected to first cables, and a second cable connector including a second insert connected to second cables. The first and the second cable connectors are connected to the board connector with the first cable connector stacked on top of the second cable connector.

When the board connector is connected to a substrate, a portion of each of the first cables adjacent to the first insert can extend parallel or substantially parallel to a major surface of the substrate, and a portion of each of the second cables adjacent to the second insert can extend parallel or substantially parallel to the major surface of the substrate.

The first insert can include holes in which corresponding first and second cable conductors of the first cables are located and teeth that support corresponding first and second mating ends of the first and second cable conductors of the first cables, and the second insert can includes holes in which corresponding first and second cable conductors of the second cables are located and teeth that support corresponding first and second mating ends of the first and second cable conductors of the second cables.

The board connector can include electrical contacts that are directly connected to corresponding first and second mating ends of first and second cable conductors of the first and second cables. The electrical contacts can be directly connected to only one side of the corresponding first and second mating ends along a length of the first and second cable conductors of the first and the second cables.

The board connector can include ground blades that extend between and along the first and second cables so that a corresponding ground blade is on each side of each of the first and second cables. The board connector can includes a first ground plane that extends under the first cable connector and a second ground plane that extends under the second cable connector.

According to an embodiment of the present invention, a die package includes a substrate that defines a first package surface and a second package surface opposed to the first package surface; a die positioned on the first package surface; first electrical connectors positioned on the first package surface; and second electrical connectors positioned on the second package surface. The first and second electrical connectors each carry differential signal pairs and each is in electrical communication with the die.

The die package can further include a pad field on the second package surface.

The first electrical connectors can be connector systems each comprising a board connector and a cable connector; the cable connector can include a first conductor that defines a first mating end, a second conductor that defines a second mating end, and an insert that carries the first conductor and the second conductor; and the first mating end can define a first contact surface, the second mating end can define a second contact surface, the first contact surface can be configured to electrically connect to a first electrical contact, and the second contact surface can be configured to electrically connect to a second electrical contact.

The first and second electrical connectors can each be a board connector that each receive at least one respective cable connector, where the at least one respective cable connector can be attached to one end of cables, and a first electrical panel connector can be attached to opposite ends of the cables. The first and second electrical connectors can include a total of at least 513 differential signal pairs, a total of at least 600 differential signal pairs, at least 700 differential signal pairs, at least 800 differential signal pairs, at least 900 differential signal pairs, at least 1000 differential signal pairs, or at least 1024 differential signal pairs.

According to an embodiment of the present invention, a cable assembly includes at least thirty-two twin axial cables, each of the at least thirty-two twin axial cables includes a first conductor and a second conductor, defines a first end and a second end opposed to the first end, and has a gauge of 34-36 AWG; at least four rows of electrical contact pairs connected to respective first ends of the at least thirty-two twin axial cables, each of the at least four rows of electrical contact pairs includes at least eight differential signal pairs; and a first electrical panel connector connected to respective second ends of the at least thirty-two twin axial cables, the first electrical panel connector includes thirty-two differential signal pairs. The cable assembly is sized and shaped such that the cable assembly will fit within a 1.75 inch height of a 1 RU panel when vertically stacked with another cable assembly.

The cable assembly can be devoid of a printed circuit board. The first electrical panel connector does not have to receive a printed circuit board.

A cable assembly system according to embodiments of the present invention includes thirty-two cable assemblies that can fit within 212 $cm^2$, 206 $cm^2$, 200 $cm^2$, and 194 $cm^2$. Thirty-two cable assemblies can carry at least 1024 cables.

According to an embodiment of the present invention, a method includes passing at least 15 terabytes/sec through an approximate 143 $cm^2$ area of a 1 RU panel using copper cables.

According to an embodiment of the present invention, a method includes passing at least 16 to 37.5 terabytes/sec through an approximate 168 $cm^2$ area of a 1 RU panel using copper cables.

According to an embodiment of the present invention, a method includes passing at least 38 terabytes/sec through an approximate 192 $cm^2$ area of a 1 RU panel using copper cables.

According to an embodiment of the present invention, a method includes passing at least 50 terabytes/sec through an approximate 192 $cm^2$ area of a 1 RU panel using copper cables.

The above and other features, elements, characteristics, steps, and advantages of the present invention will become more apparent from the following detailed description of embodiments of the present invention with reference to the attached drawings.

DETAILED DESCRIPTION

Connector systems described herein can include a first connector and a mating second connector. Board connectors can be a first connector; and first, second, and third cable connectors can be mating second connectors. Alternatively, board connectors can be a second mating connector; and first, second, and third cable connectors can be respective first connectors. First, second, and third cable connectors can include a cable that includes a first cable conductor and a second cable conductor. Cable assemblies can include a cable with a first, second, or third cable connector attached to one end of the cable, and a first electrical panel connector attached to an opposed end of the cable.

Figure 1:
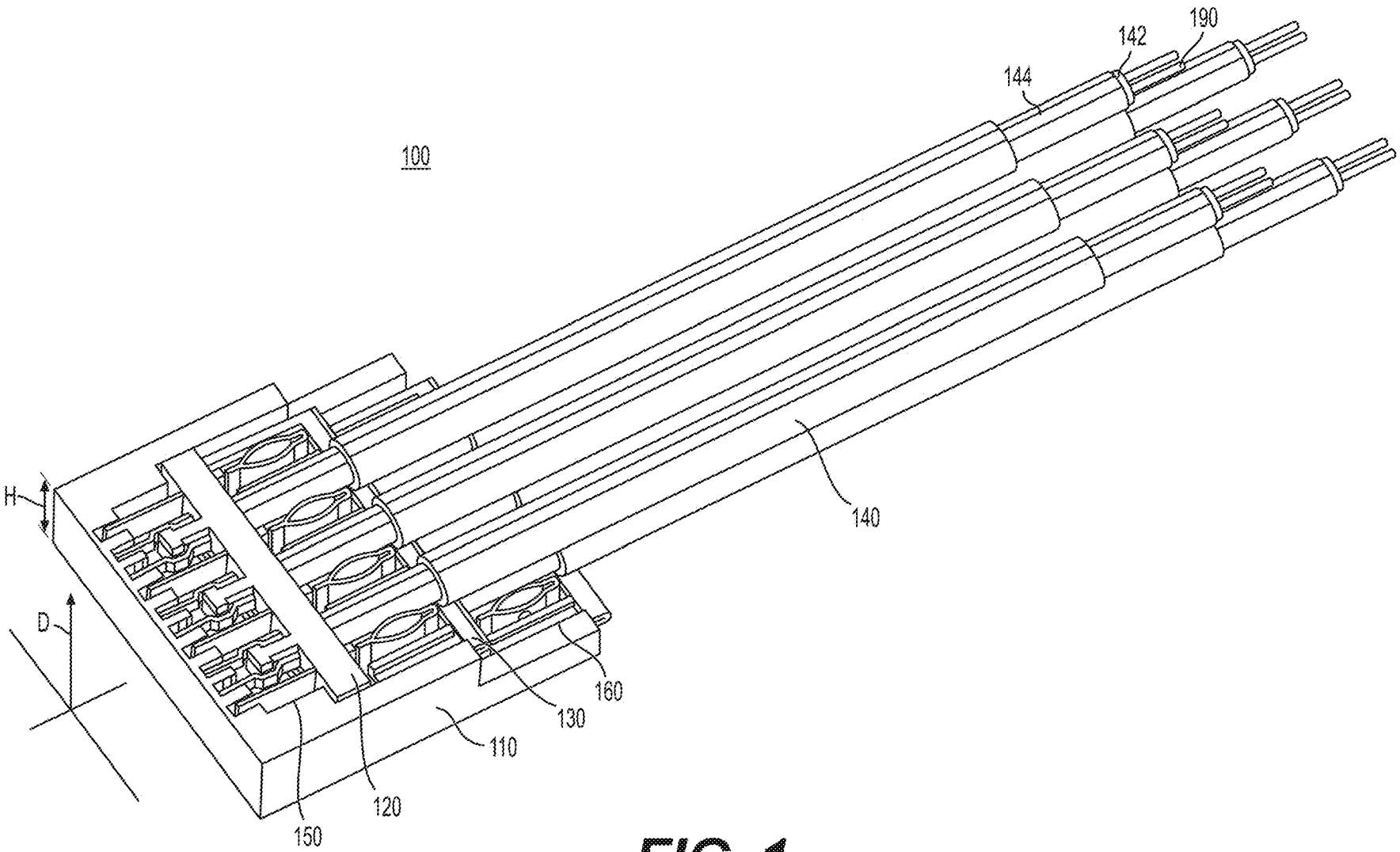
FIGS. 1 and 2 show a connector system including a board connector and two cable connectors according to a first embodiment.

FIG. 1 shows a connector system 100 that includes a board connector 110, a first cable connector 120, a second cable connector 130, and a plurality of cables 140. The board connector 110 is attached to a suitable substrate (not shown), including, for example, a printed circuit board. The board connector 110 can define a stair step shape, with a first connector mating interface 150 offset from and elevated from a second connector mating interface 160. First board connector 110 can also be a right angle connector.

The second cable connector 130 is connected to the board connector 110 first, and then the first cable connector 120 is connected to the board connector 110. The first and second cable connectors 120, 130 are connected to the board connector 110 by inserting the first and second cable connectors 120, 130 from an insertion/unmate direction that is orthogonal or substantially orthogonal, within manufacturing tolerances, to a major surface of the substrate on which the board connector 110 is mounted. Alternatively, the second cable connector 130 can also be rotated into position in the second connector mating interface 160, and the first cable connector 120 can be rotated into position in the first connector mating interface 150. The first cable connector 130 can at least partially overlap the second cable connector 130 when the first and second cable connectors 120, 130 are both electrically connected to the board connector 110. Each of the first and second cable connectors 120, 130 can have respective electrical cables 140 attached thereto. Cable 140 can be twin axial cables, coaxial cables, extruded twin axial cables, shielded cables, or any other suitable cables. In differential signal applications, cable 140 could be twin axial cable or individual coaxial cables. Cable 140 can be 26-36 AWG differential signal cables, such as 32, 33, 34, 35 or 36 AWG. Individual coaxial cables can each have smaller cross-sectional diameters/larger AWGs.

Any cable 140 described herein can include an electrical insulator 142 that at least partially surrounds a first conductor or a first cable conductor 190, an electrically conductive cable shield 144 that at least partially surrounds the electrical insulator 142, and an outer electrically non-conductive jacket 146 that at least partially surrounds the electrically conductive cable shield 144.

With the stacked arrangement of first and second cable connectors 120, 130, it is possible to achieve a mated stack height of the cable connector system, determined by the height H of a board connector housing of the board connector 110, which can be about 1.5 mm in length for a one row board connector and about 3 mm in length for a two row board connector. Cable 140 portions adjacent to the first and second cable connectors 120, 130 can each extend parallel or substantially parallel within manufacturing tolerances to the substrate to which the board connector 110 is mounted. Although FIG. 1 shows first and second cable connectors 120, 130 connected to the board connector 110, it is possible that more than two cable connectors can be connected to the board connector, which would increase both the footprint and stack height of the board connector. For example, as shown in FIG. 1, height H of a board connector housing of the board connector 110 can be about 4.5 mm for a three row board connector and about 6 mm for a four row board connector.

Figure 2:
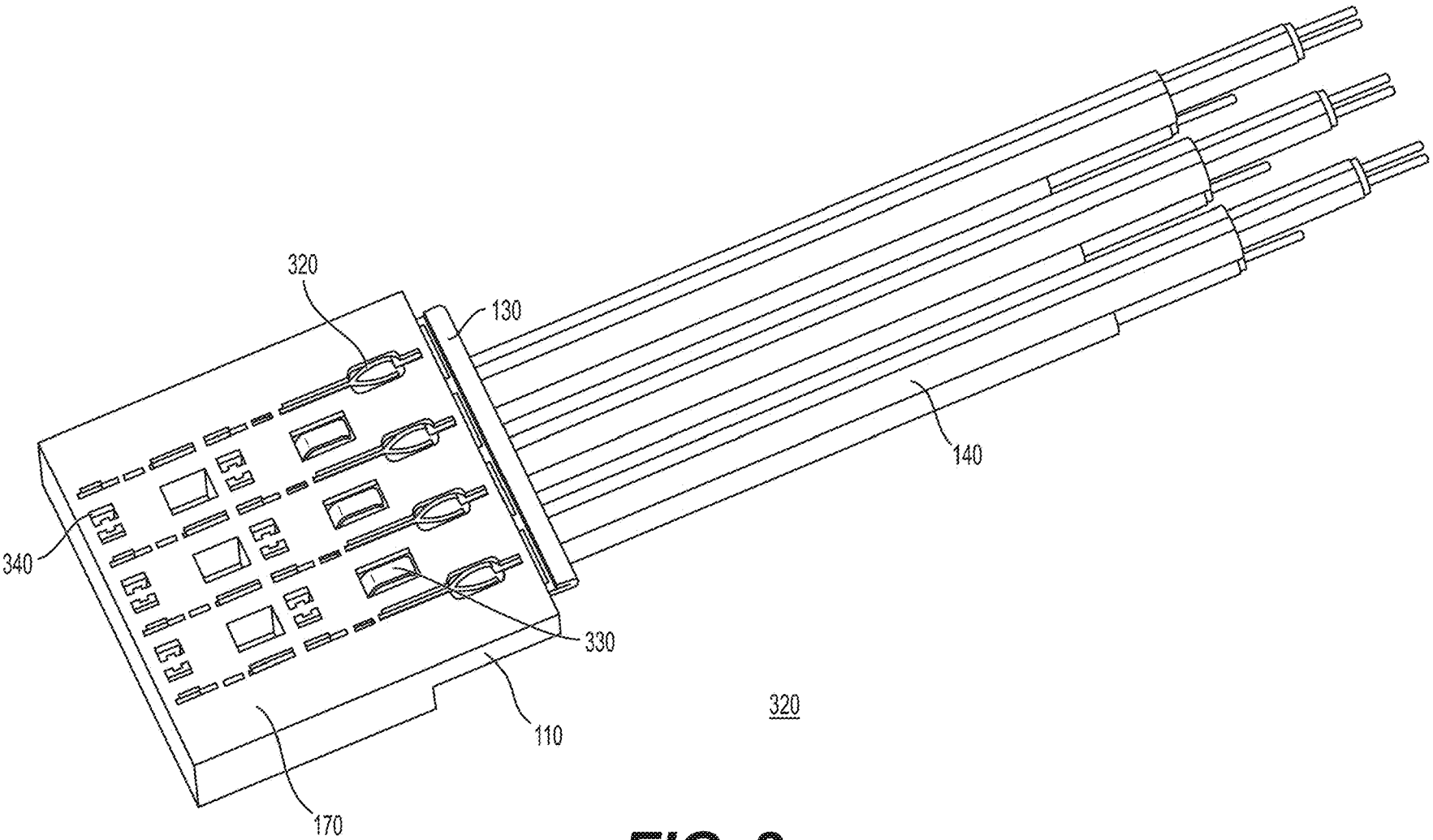

FIG. 2 is a bottom view of the connector system 100 shown in FIG. 1. Second cable connector 130, cables 140, a board connector mounting interface 170 are shown. Mount ends of ground blade 320, ground plane 330, and mount ends of electrical contact 340 are shown.

Figure 3:
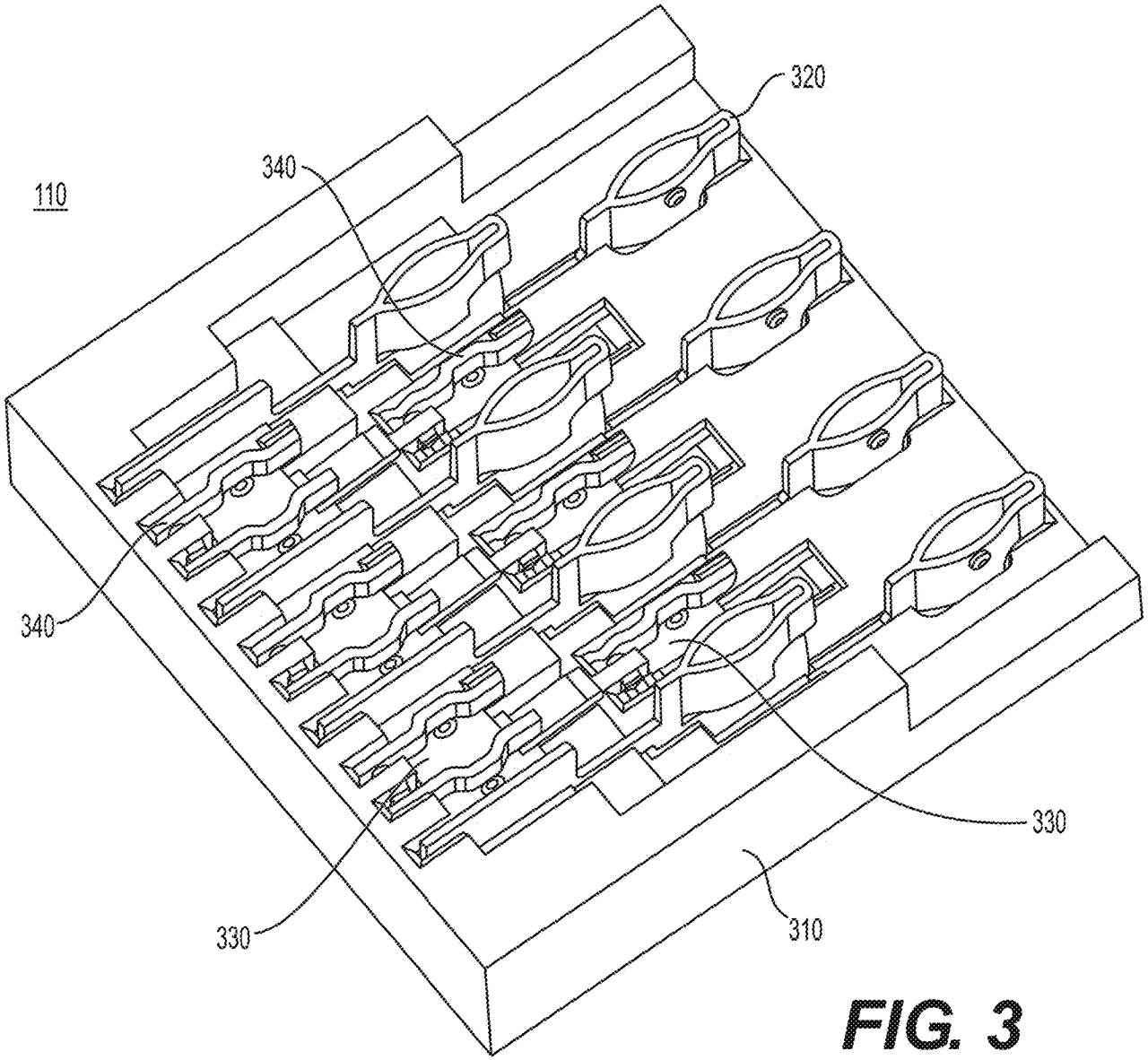
FIGS. 3 and 4 show the board connector of FIG. 1.

FIG. 3 is a top perspective view of the board connector 110. The board connector 110 can include a board connector housing 310, ground blades 320, ground planes 330, and electrical contacts 340. The board connector housing 310 can be made of any suitable dielectric material. The ground blades 320, ground planes 330, and electrical contacts 340 can be made from any suitable electrically conductive material. The ground blades 320, ground planes 330, and electrical contacts 340 can be made by stamping or any other suitable method.

The board connector 110 can include four or more ground blades 320. As shown in FIG. 1, two ground blades can flank or be positioned on opposed sides of cable 140. As shown in FIG. 3, board connector 110 can include two ground planes 330, with one ground plane 330 for each respective first and second cable connector 120, 130. Board connector 110 can include two electrical contacts 340 for each cable connected to the board connector 110. The board connector 110 can include any number of ground blades 320, any number ground planes 330, and any number of electrical contacts 340, depending on the number of cables 140 per first and second cable connectors 120, 130, and depending on the number of first and second cable connectors 120, 130. If there are M cables 140 per first or second cable connector 120, 130, then the board connector 110 can include M+1 ground blades 320 to ensure that each cable 140 is surrounded or flanked by two ground blades 320 oriented parallel to the cables 140.

The ground blades 320 can be used with both of the first and second cable connectors 120, 130, but it is possible to use two separate ground blades 320 for the first and second cable connectors so that the board connector 110 includes 2*(M+1) ground blades 320. If there are N first and second cable connectors 120, 130, then the board connector 110 can include N ground planes 330. If there are P total cables 140 in both the first and second cable connectors 120, 130, then the board connector 110 can include 2*P electrical contacts 340, assuming each cable 140 is a twin axial cable with two center conductors. If the cables 140 are coaxial cables with a single center conductor, then the board connector 110 can include P electrical contacts 340.

Figure 4:
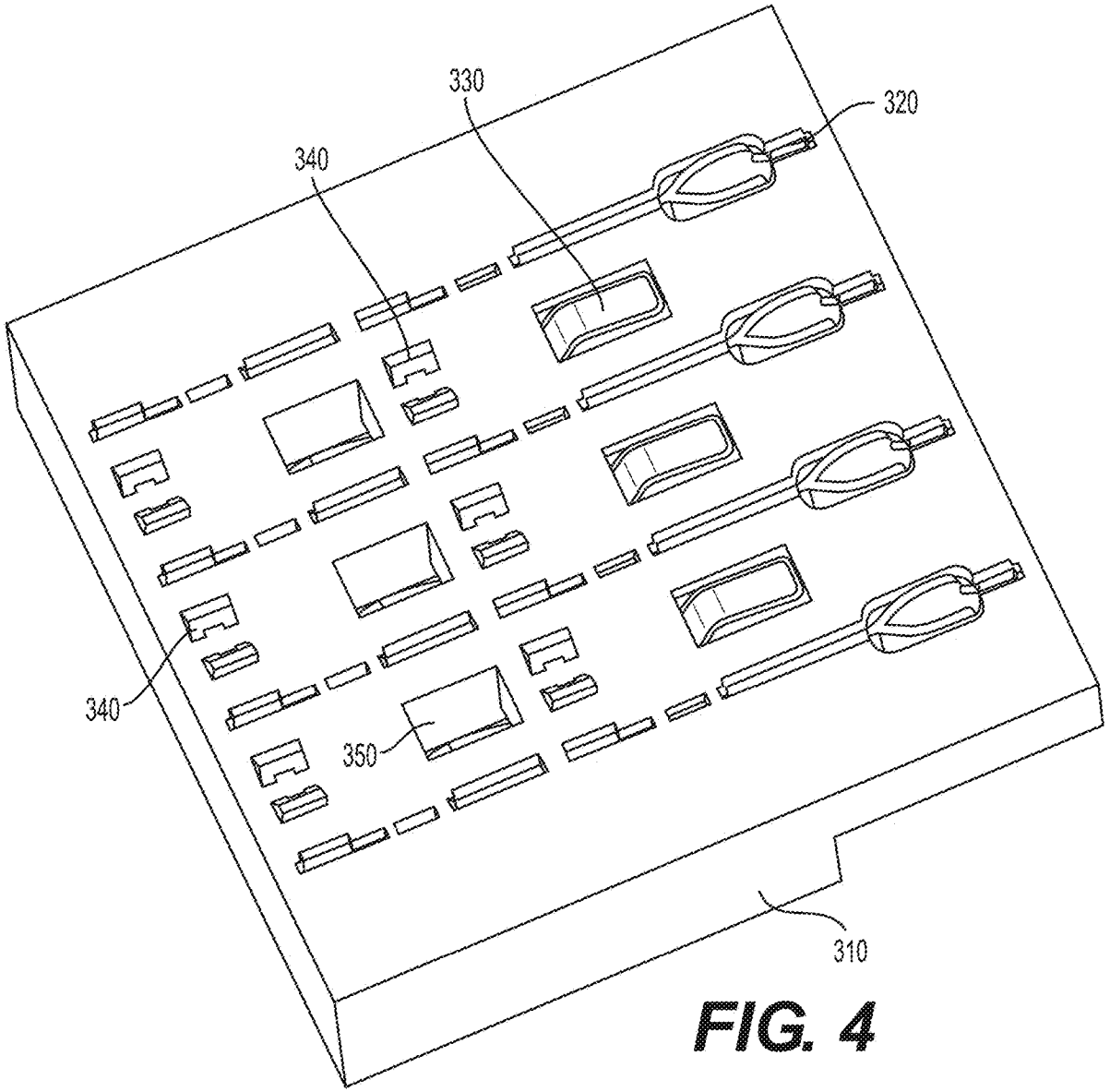

FIG. 4 is a bottom perspective view of board connector 110. Board connector housing 310 defines openings 350 and the ground blades 320, ground planes 330, and electrical contacts protrude into or through the openings 350.

Figure 5:
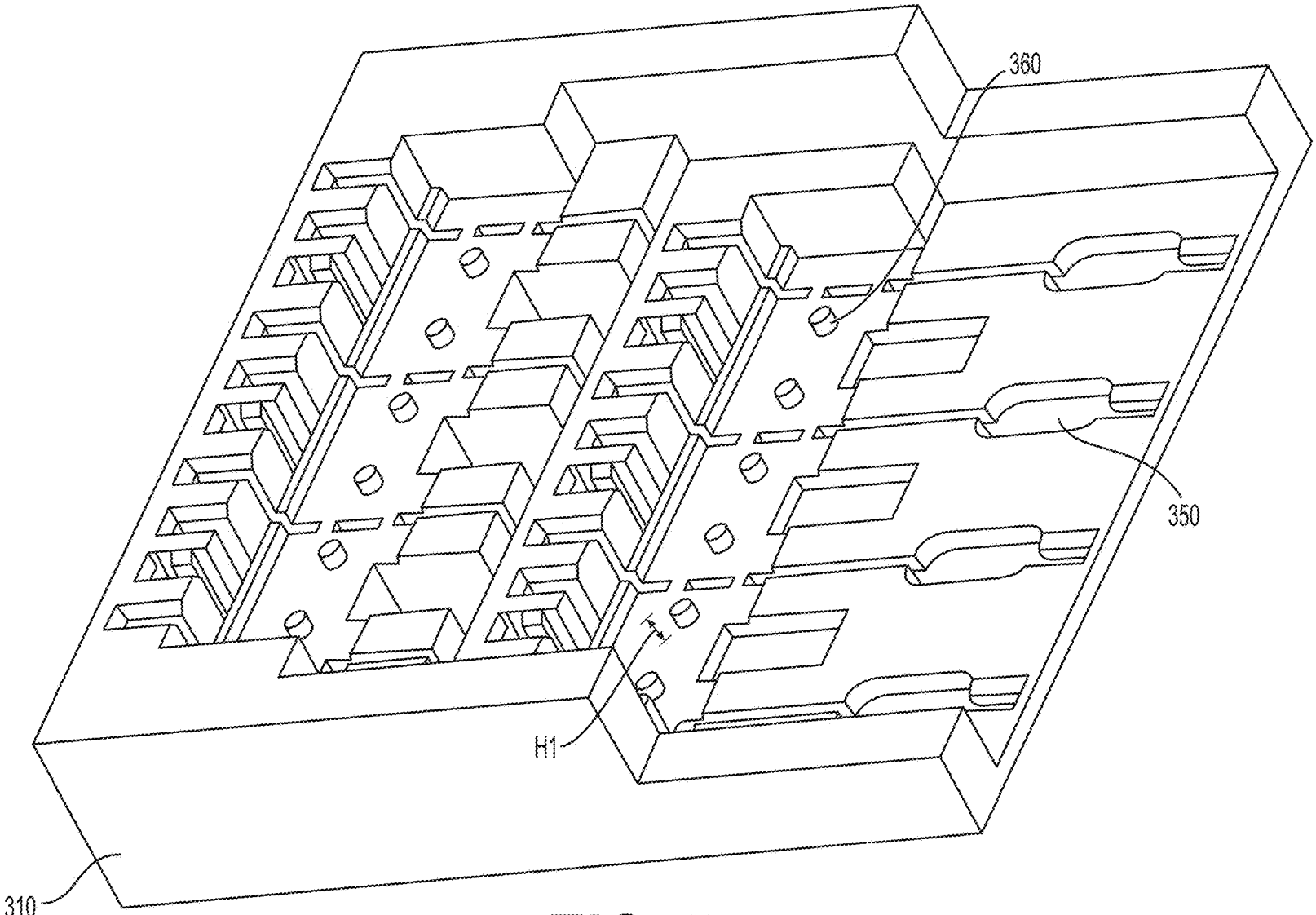
FIG. 5 shows the board connector housing of the board connector of FIG. 3.

FIG. 5 shows the board connector housing 310 of the board connector 110, with electrically conductive parts removed for clarity.

As discussed above, the board connector housing 310 can define openings 350 that receive the ground blades, the ground planes, and the electrical contacts. The board connector housing 310 can further define protrusions 360 that engage with corresponding holes defined by the ground plane. The height H1 of the protrusions 360 in the board connector housing 310 can also be chosen such that the protrusion 360 engages with a respective one of the first cable connector 120 and second cable connector 130 when the first and second cable connectors 120, 130 are connected to the board connector 110.

Figure 8:
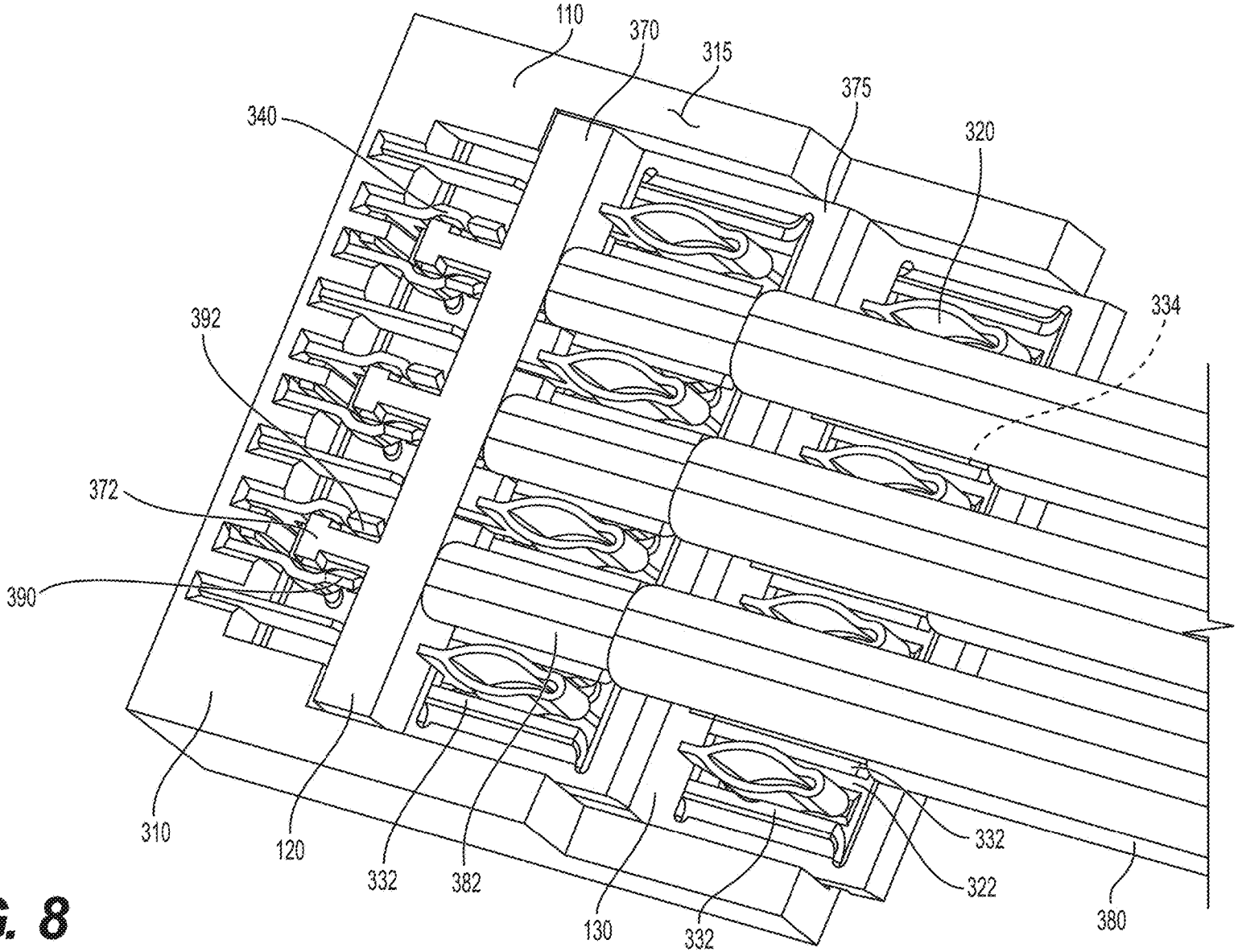
FIG. 8 is a close-up view of the connector system of FIG. 1.

The board connector housing 310 can define an open end 314 and a floor 316. First and second cable connectors 120, 130 (shown in FIG. 1) can be inserted into the board connector housing 310 in a direction orthogonal to both the open end 314 and the floor 316 or can be rotated in a direction toward the floor. The open end 314 and the floor 316 can both extend parallel to a mounting substrate, and perpendicular or substantially perpendicular to the height H1 of the protrusions 360. The second connector mating interface 160 can be offset from the first connector mating interface 150 and can be elevated farther from the floor 316 than the first connector mating interface 150. The open end 314 permits the second cable connector 130 (as shown in FIG. 8) or the electrical contacts 340 to remain exposed after the first cable connector 120 (as shown in FIG. 8) is mated to the board connector housing 310. Stated another way, the electrical contacts 340 are bounded by only four walls, such as floor 316, first and second parallel sidewalls 318*a*, 318*b* that each extend perpendicular to the floor 316, and rear wall 319 that extends perpendicular to the floor 316 and perpendicularly intersects each of the first and second parallel sidewalls 318*a*, 318*b*. Each of the first and second parallel sidewalls 318*a*, 318*b* can define a stepped or L-shape.

Figure 6:
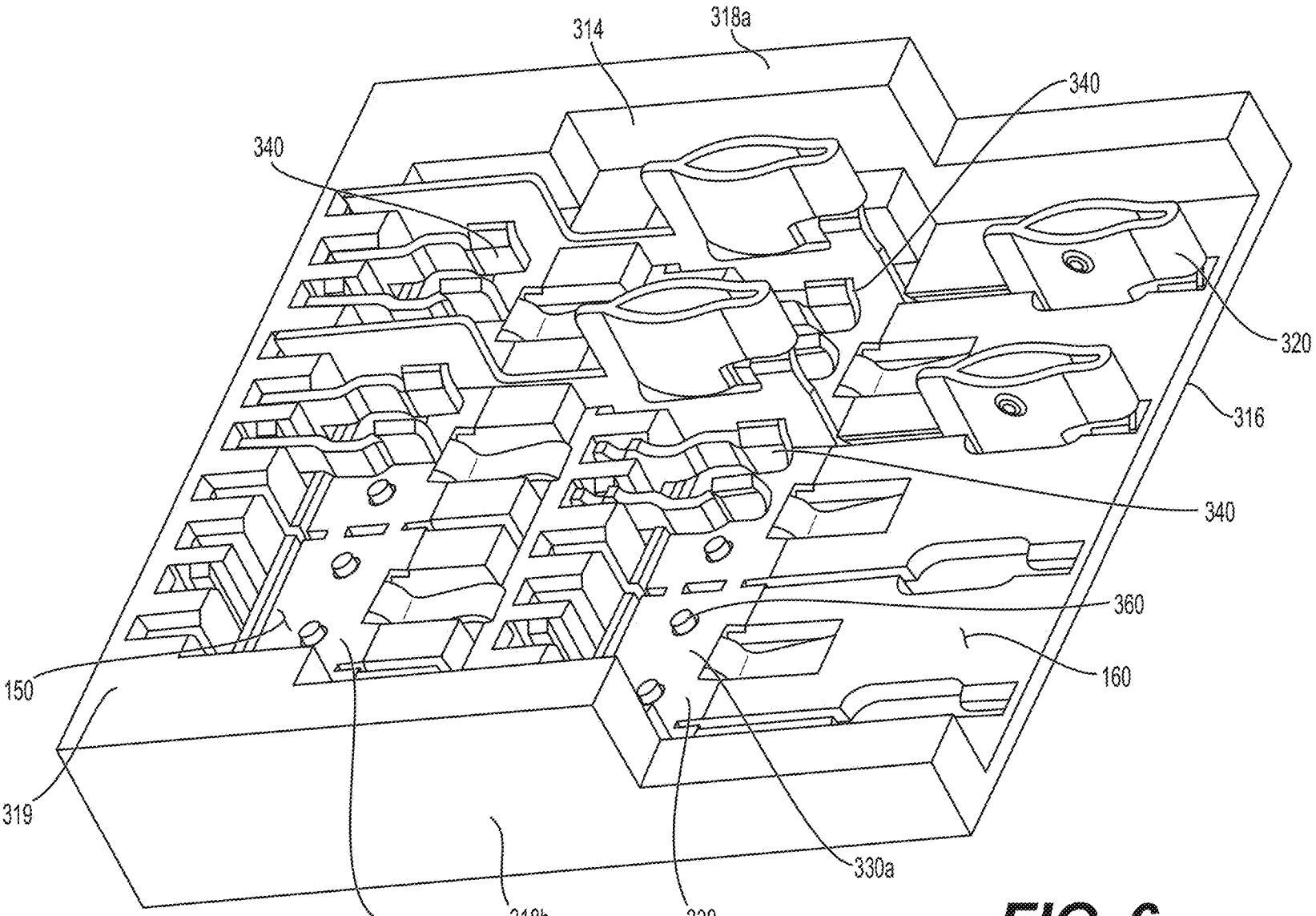
FIGS. 6 and 7 show partially assembled board connectors of FIG. 3.

FIG. 6 shows a partially assembled board connector 110, populated with only two ground blades 320 and only four pairs of electrical contacts 340. As shown, the ground blades 320 act as interstitial shields between immediately adjacent pairs of electrical contacts 340 in a respective one of the first connector mating interface 150 and the second connector mating interface 160. The ground blades 320 and ground planes 330, such as first and second ground planes 330*a*, 330*b*, can be arranged to surround the electrical contacts 340 and the first and second cable conductors 390, 392 (shown in FIG. 8) on three sides, partially extending the arrangement from the cable 380 (shown in FIG. 8) in which the first and second cable conductors 390, 392 (shown FIG. 8) are completely surrounded by the cable shield 382 (shown in FIG. 7) in the cable 380 (shown in FIG. 7). The ground blades 320, ground planes 330, connector shields 375, and cable shields 383 can all be electrically connected together and can all be connected to ground or reference. The interaction of the ground blades 320 and the connector shields 375 also provides retention of the first and second cable conductors on the board connector 110 without an additional active or passive latch.

Figure 7:
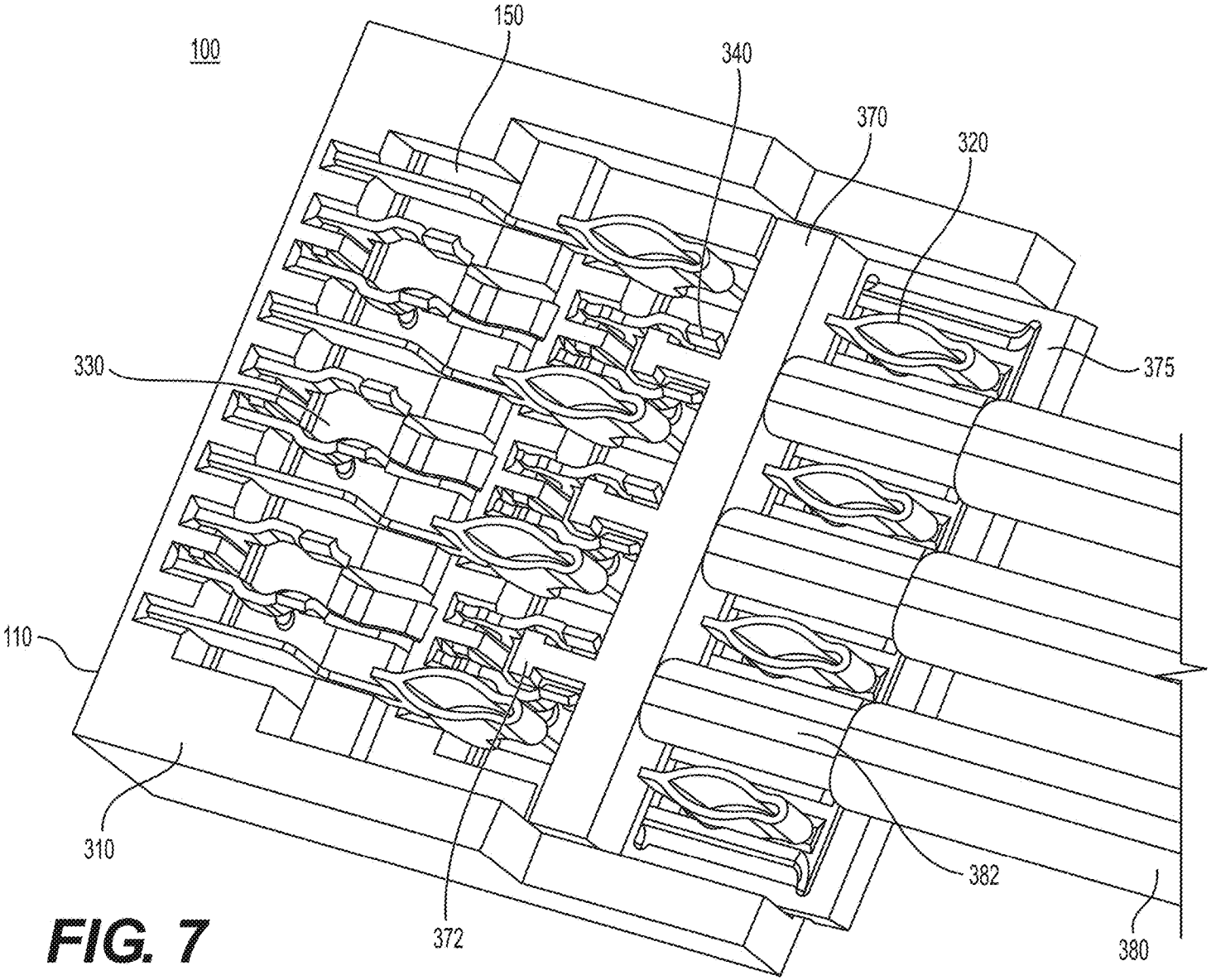

FIG. 7 shows a partially assembled connector system 100 with only the second cable connector 130 connected to the board connector housing 310 of the board connector 110. Ground blades 320 are electrically connected to cable shield 382 of the cable 380. Ground plane 330 is positioned underneath differential signal pairs or other pairs of electrical contacts 340 in the first connector mating interface 150. Connector shield 375 is carried by the second cable connector 130. The second cable connector 130 may further include an insert 370 that may define a tooth 372.

FIG. 8 shows first and second cable connectors 120, 130 connected to the board connector 110. The board connector 110 can carry electrical contacts 340, such as differential signal pairs; ground blades 320; and a ground plane 330 (not shown in FIG. 8). The first cable connector 120 can be flush with a first surface 315 of the board connector housing 310 of the board connector 110, be recessed into the first surface 315, or extend beyond the first surface 315. Ground blades 320, carried by the board connector housing 310, are positioned in spaces 322 defined by immediately adjacent protruding walls 332 of respective connector shields 375 of the first and second cable connectors. Cables 380 are positioned in grooves 334 defined by immediately adjacent protruding walls 332 of the respective connector shields 375, such that cable shield 382 is in electrical contact with grooves 334 of the respective connector shields 375. The pattern of protruding wall 332, ground blade 320, protruding wall 332, cable 380, protruding wall 332, and ground blade 320 can be repeating.

Insert 370 of a respective first or second cable connector 120, 130 can be made from an electrically non-conductive material and can define a tooth or one or more teeth 372. Insert 370 can carry the connector shield 375, cables 380, respective cable shields 382, respective first and second cable conductors 390, 392 of the respective cables 380, and electrically non-conductive material positioned between the respective first and second cable conductors 390, 392 and the respective cable shields 382. First and second cable conductors 390, 392 are stripped bare and may both extend through the insert 370 and through a respective tooth 372 so that one tooth carries both the first and second cable conductors 390, 393. The first cable conductor 390 electrically connects with a respective electrical contact 340, but only one side of the first cable conductor 390. The second cable conductor 392 electrically connects with a respective electrical contact 340, but only one side of the second cable conductor 392. When a first or second cable connector 120, 130 is connected to the board connector 110, the first and second cable conductors 390, 392 are already exposed, and the electrical contacts 340 do not cut the jacket, cable shield 382, or dielectric layer of a respective cable 380. The electrical contacts 340 can electrically connect to respective first and second cable conductors 390, 392 by a spring force exerted on a respective first or second cable conductor 390, 392. First and second cable connectors 120, 130 can be identical or substantially identical in construction. Tooth or teeth 372 can have a larger cross-sectional area than the first cable conductor 390 or the second cable conductor 392.

Figure 9:
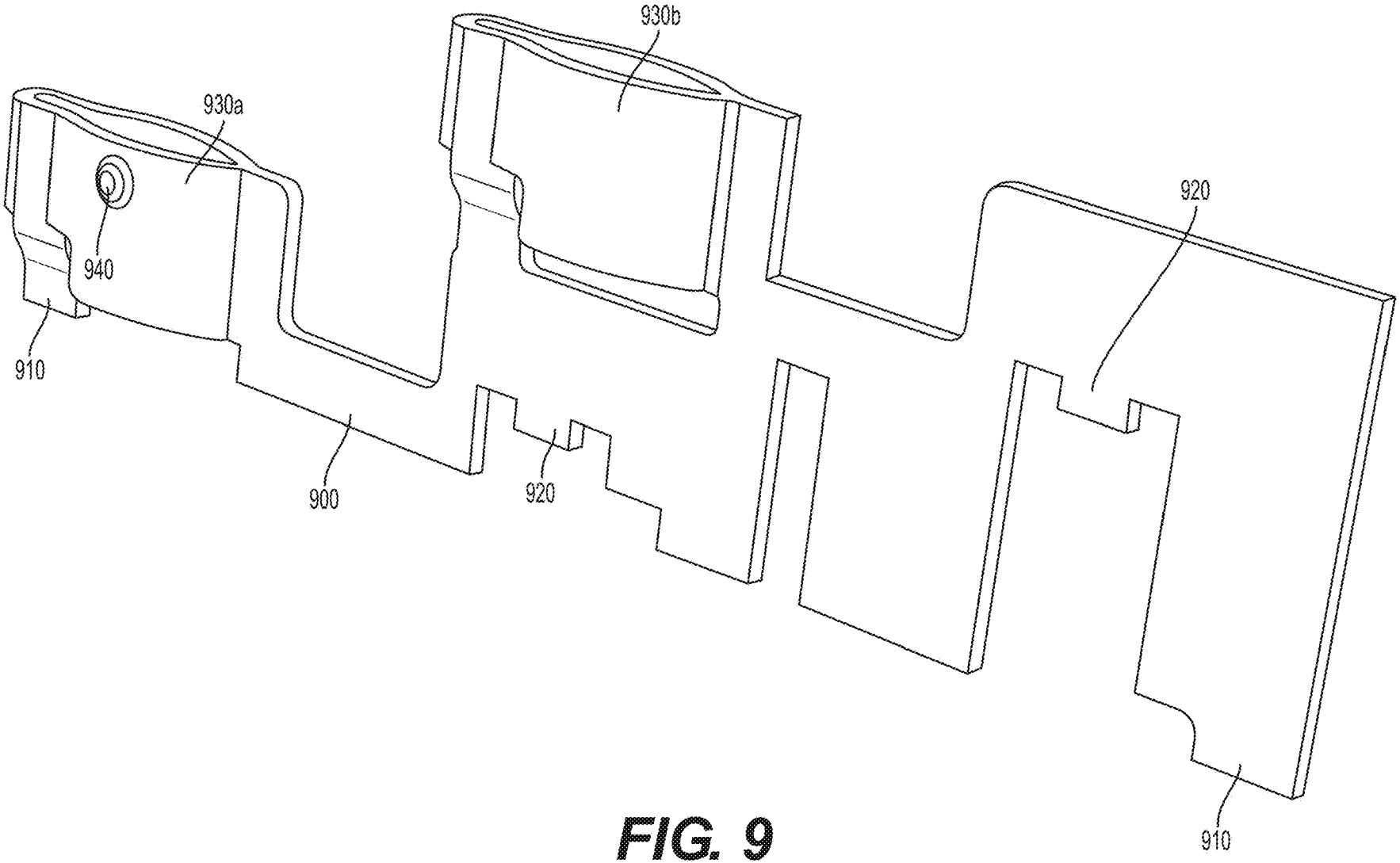
FIG. 9 shows a ground blade that can be used with the board connector housing of FIG. 5.

FIG. 9 shows a ground blade 900 that can be inserted into the holes in the board connector housing 310, FIG. 3. The ground blade 900 can include tails 910 that can be soldered to a substrate using surface-mount technology (SMT). Instead of including SMT tails to mount the ground blade 900 to the substrate, the ground blade 900 can include press-fit tails, through-hole tails, or any other suitable structure to mount the ground blade 900 to the substrate. The ground blade 900 also includes legs 920 that may be inserted into holes 1010 (shown in FIG. 10) in the ground planes 1000 (shown in FIG. 10). The ground blades 900 can also include two springs, such as first spring 930*a* and second spring 930*b*. Each of the first and second springs 930*a*, 930*b* can be inserted into spaces 322 (shown in FIG. 8) in the connector shield 375 of the first or second cable connector 120, 130 (shown in FIG. 1) to help secure the first and second cable connectors 120, 230 to the board connector 110 (shown in FIG. 1).

Referring again to FIG. 9, the number of springs can depend on the number of cable connectors. For example, as seen in FIG. 8, each ground plane 330 can include two springs, with one spring engaging the second cable connector 130 and with the other spring engaging the first cable connector 120, but it is possible to use a different number of springs. As shown in FIG. 9, the first spring 930*a* can include bosses 940 on opposite sides of the first spring 930*a*. The bosses 940 help keep the second cable connector 130 mated with the board connector 110.

Figure 10:
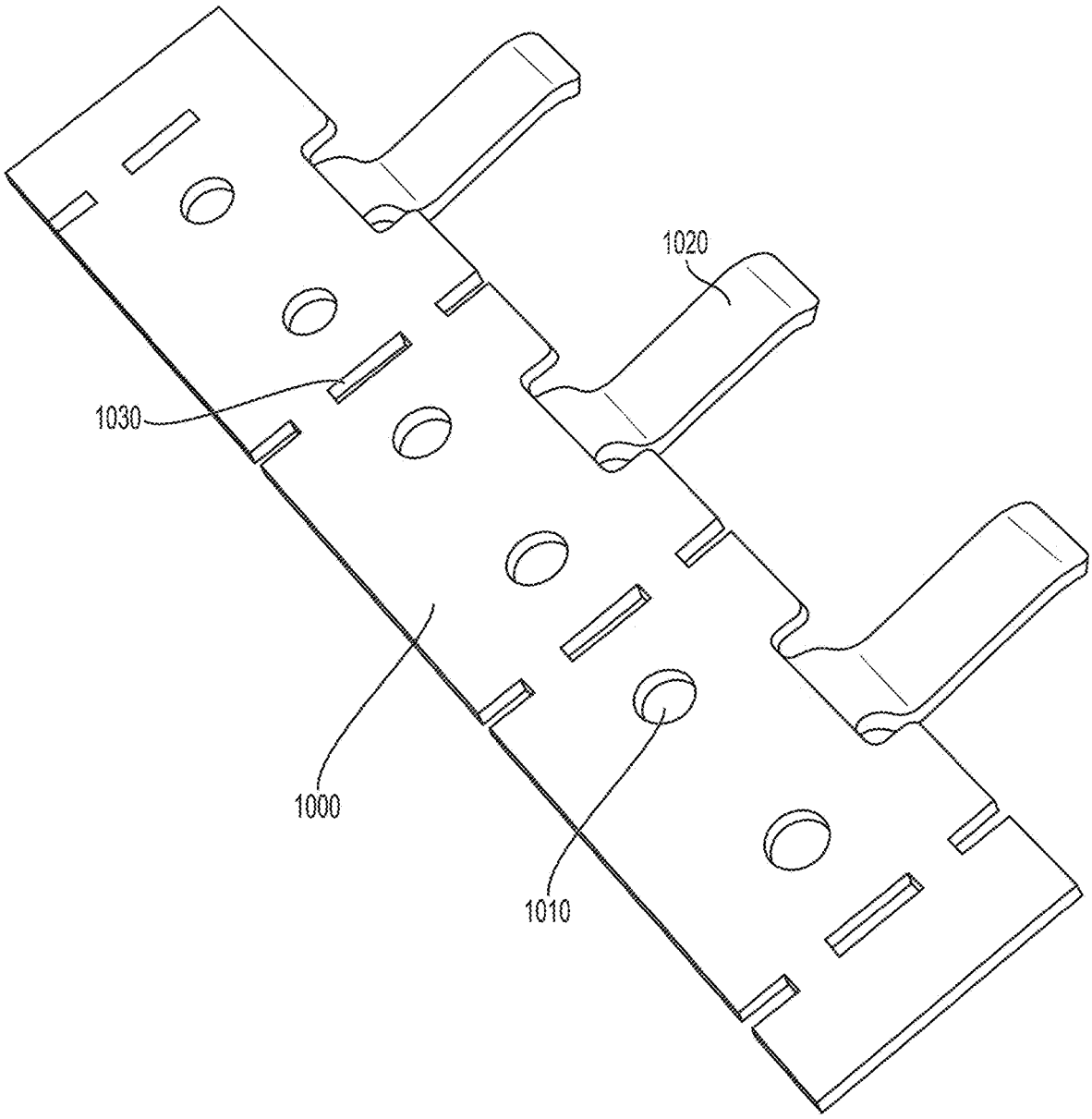
FIG. 10 shows a ground plane that can be used with the board connector housing of FIG. 5.

FIG. 10 shows a ground plane 1000 similar to the ground plane 330 (shown in FIG. 6) that can be used within the first connector mating interface 150 (shown in FIG. 1), the second mating interface 160 (shown in FIG. 1), or both. The ground plane 1000 can include holes 1010 that engage with the protrusions 360 (shown in FIG. 5) in the board connector housing 310 (shown in FIG. 5). The ground plane 1000 can include ground plane arms 1020. Respective ground plane arms 1020 can extend into openings 350 (shown in FIG. 4) in the board connector housing 310 (shown in FIG. 3) and can engage with a connector shield 375 (shown in FIG. 7) of corresponding first or second cable connectors 120, 130 (shown in FIG. 1). Slots 1030 can receive corresponding legs 920 (shown in FIG. 9) of the ground blades 900 (shown in FIG. 9).

Figure 11:
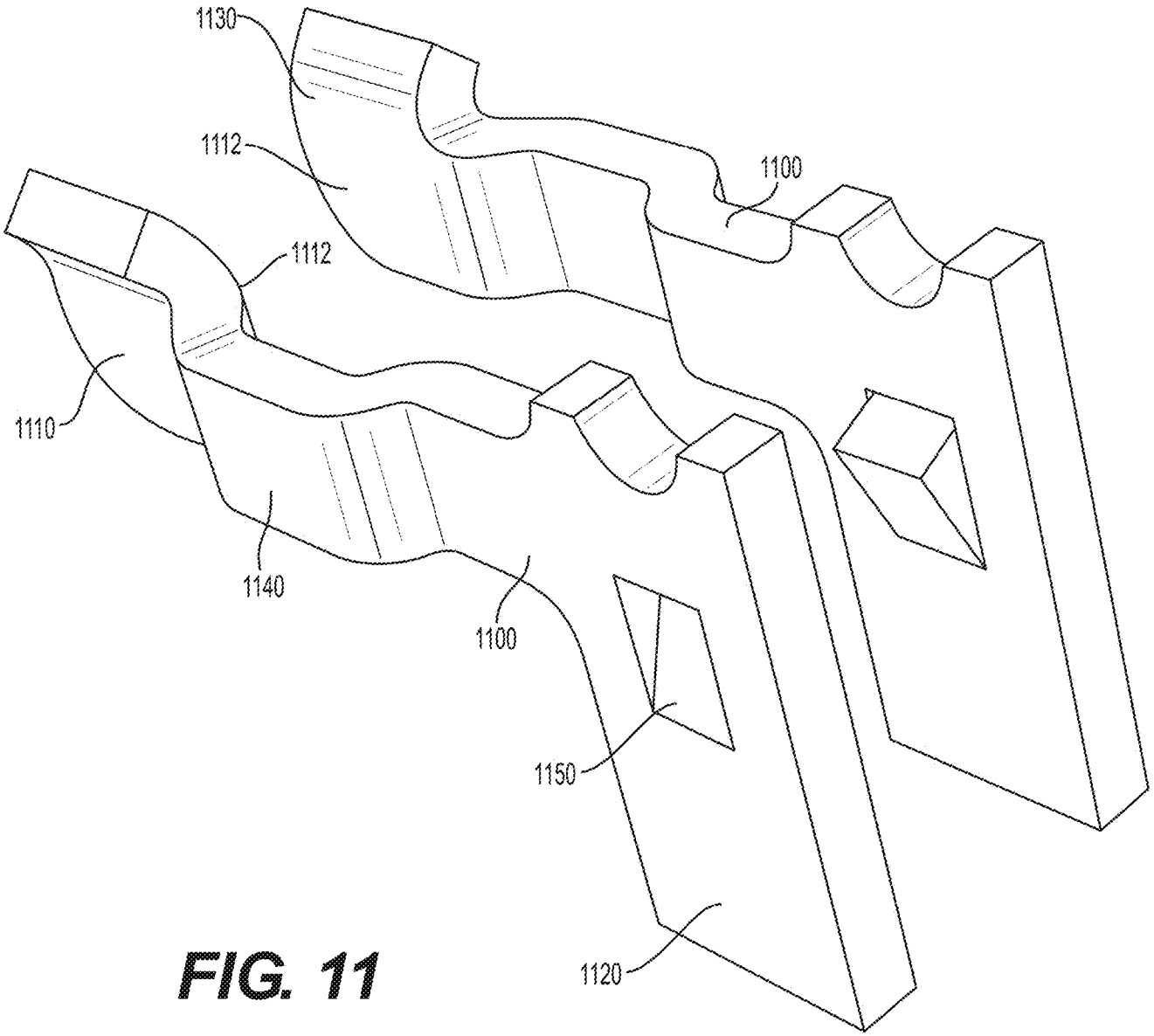
FIGS. 11 and 12 show contacts that can be used with the board connector housing of FIG. 5.

FIG. 11 shows a contact pair of electrical contacts 1100 that can be used in the second connector mating interface 160 (shown in FIG. 1) of the board connector 110 (shown in FIG. 1). Instead of contact pairs, a single electrical contact 1100 can be used if the cables 380 (shown in FIG. 8) include a single first cable conductor 390 (shown in FIG. 8). Each electrical contact 340 can be cantilevered, including a head 1110 and tail 1120 that are connected at 90° or approximately 90° within manufacturing tolerances. Respective opposing surfaces 1112 of the heads 1110 of the contact pair of electrical contacts 1100 can contact or electrically contact only a single exterior portion of the first and second cable conductors 390, 392 (shown in FIG. 8) of the cable 380 (shown in FIG. 8). The heads 1110 can include a lead-in 1130 and a bend 1140 to assist with mating with a corresponding first or second cable conductor 390, 392 (shown in FIG. 8) of the cable 380 (shown in FIG. 8). The lead-ins 1130 can assist in guiding a tooth or the teeth 372 (shown in FIG. 8) of a respective first and second cable connector 120, 130 (shown in FIG. 8) when the first and second cable connectors 120, 130 (shown in FIG. 8) are mated with the board connector 110 (shown in FIG. 8). The bend 1140 can be shaped to accommodate the end of a corresponding tooth 372 (shown in FIG. 8). The tail 1120 can be surface mounted to a substrate. Alternatively, the tail 1120 can include a press-fit tail, a through-hole tail, or any other suitable structure to attach the electrical contacts 1100 to the substrate. The electrical contacts 1100 that can be used with the second connector mating interface 160 (shown in FIG. 1) of the board connector 110 (shown in FIG. 1) can each include a retention wedge 1150 to help secure the respective electrical contact 1100 in the board connector housing 310 (shown in FIG. 7) of board connector 110 (shown in FIG. 7).

Figure 12:
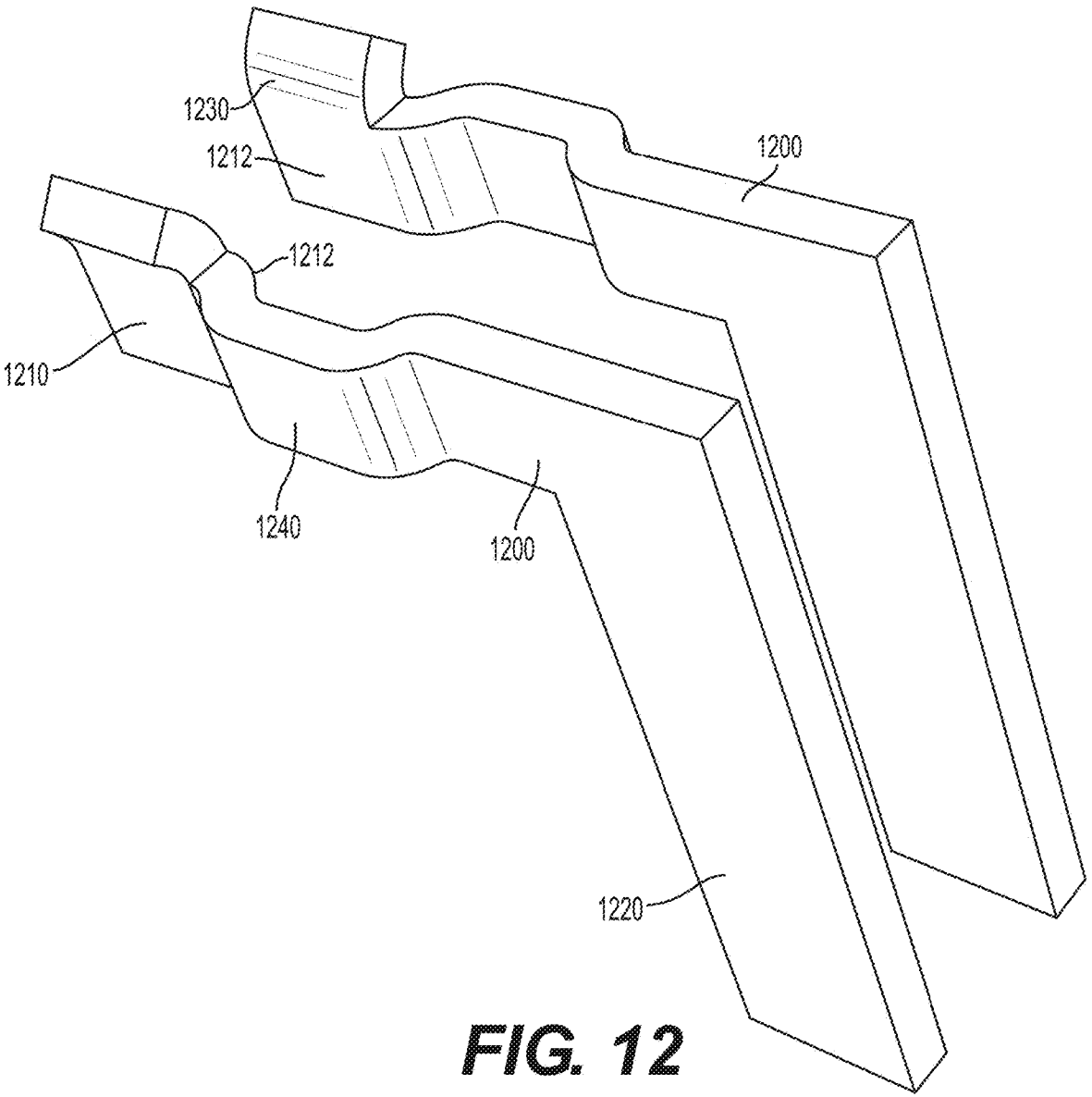

FIG. 12 shows a contact pair of electrical contacts 1200 that can be used in the first connector mating interface 150 (shown in FIG. 1) of the board connector 110 (shown in FIG. 1). Instead of contact pairs, a single electrical contact 1200 can be used if the cables 380 (shown in FIG. 8) include a single first or second cable conductor 390 (shown in FIG. 8). Each electrical contact 1200 can be cantilevered, including a head 1210 and tail 1220 that are connected at 90° or approximately 90° within manufacturing tolerances. Respective opposing contact surfaces 1212 of the heads 1210 of the contact pair of electrical contacts 1200 can contact or electrically contact only a single exterior portion of a corresponding first and second cable conductor 390, 392 (shown in FIG. 8), such as a first contact surface 1397 (shown in FIG. 22) and a second contact surface 1398 (shown in FIG. 22). The heads 1210 can include a lead-in 1230 and a bend 1240 to assist with mating with the first and second cable conductors 390, 392 (shown in FIG. 8) of the cable 380 (shown in FIG. 8). The lead-ins 1230 can assist in guiding a tooth or the teeth 372 (shown in FIG. 8) of a respective first and second cable connector 120, 130 (shown in FIG. 8) when the first and second cable connectors 120, 130 (shown in FIG. 8) are mated with the board connector 110 (shown in FIG. 8). The bend 1240 can be shaped to accommodate the end of a corresponding tooth 372 (shown in FIG. 8). The tail 1220 can be surface mounted to a substrate. Alternatively, the tail 1220 can include a press-fit tail, a through-hole tail, or any other suitable structure to attach the electrical contacts 1200 to the substrate. The electrical contacts 1200 that can be used with the first connector mating interface 150 (shown in FIG. 1) of the board connector 110 (shown in FIG. 1) can each include a retention wedge similar to retention wedge 1150 (shown in FIG. 11) to help secure the respective electrical contact 1200 in the board connector housing 310 (shown in FIG. 7) of board connector 110 (shown in FIG. 7).

Figure 13:
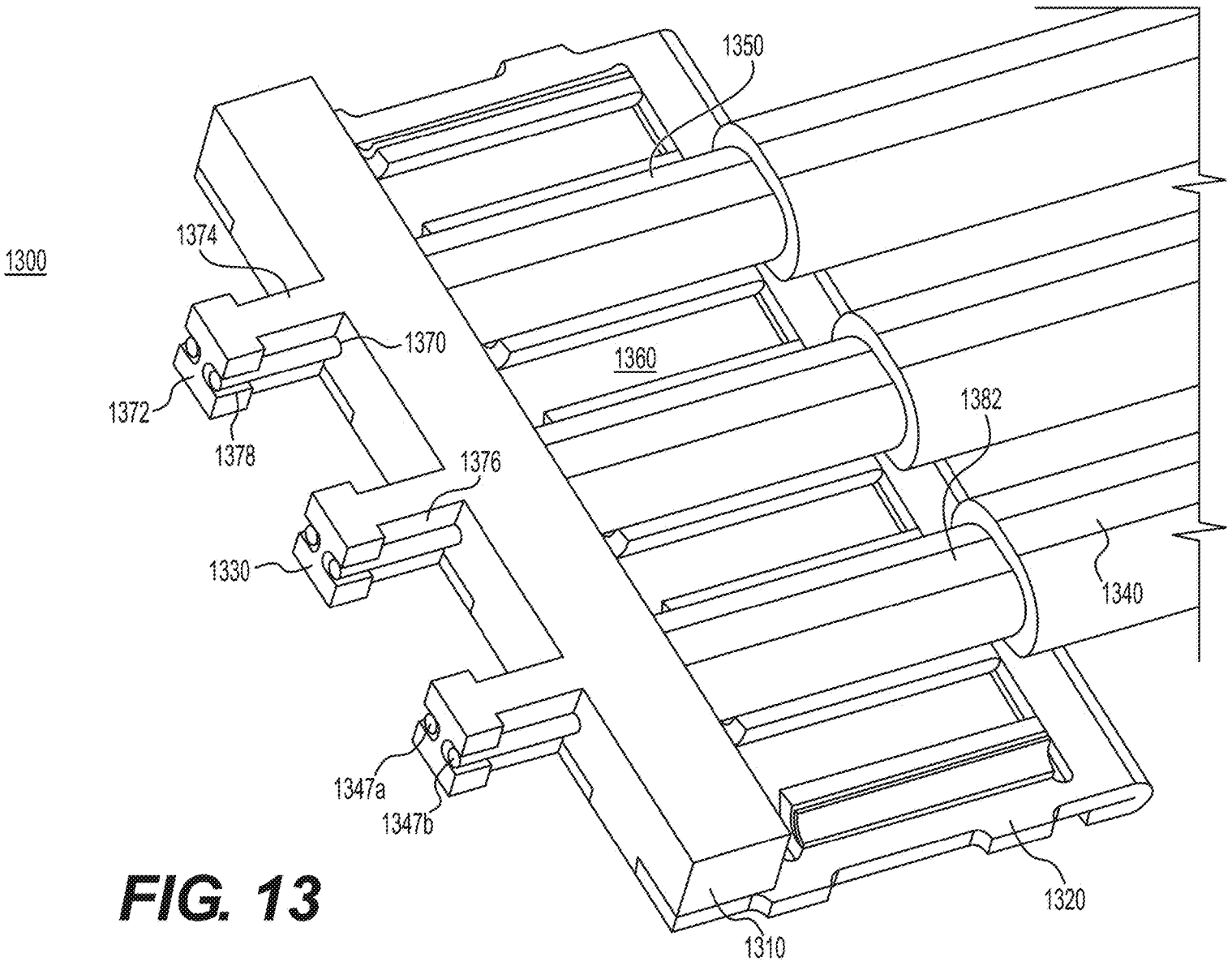
FIGS. 13 and 14 show an end of the cable connector with the insert.
Figure 14:
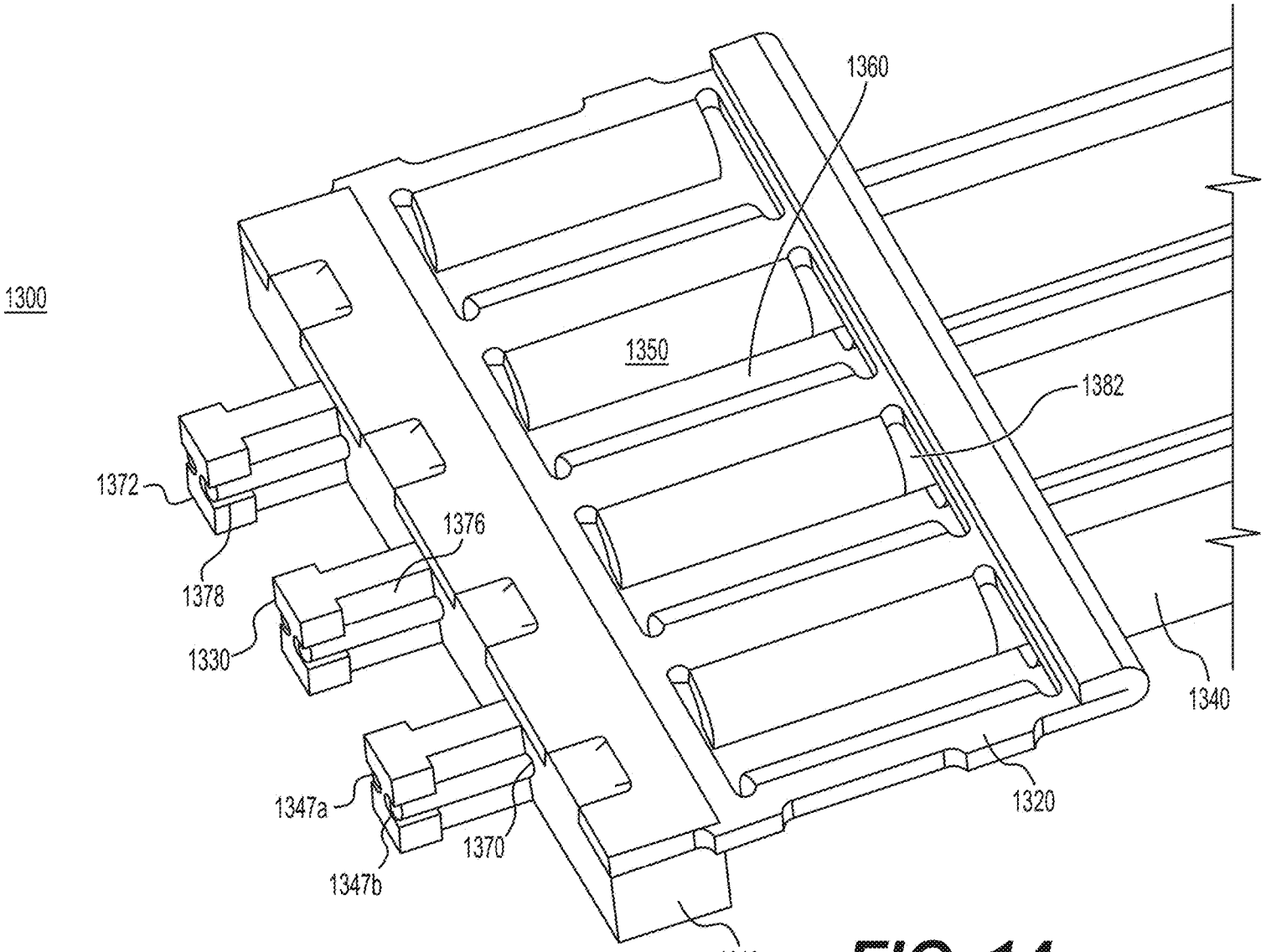
Figure 15:
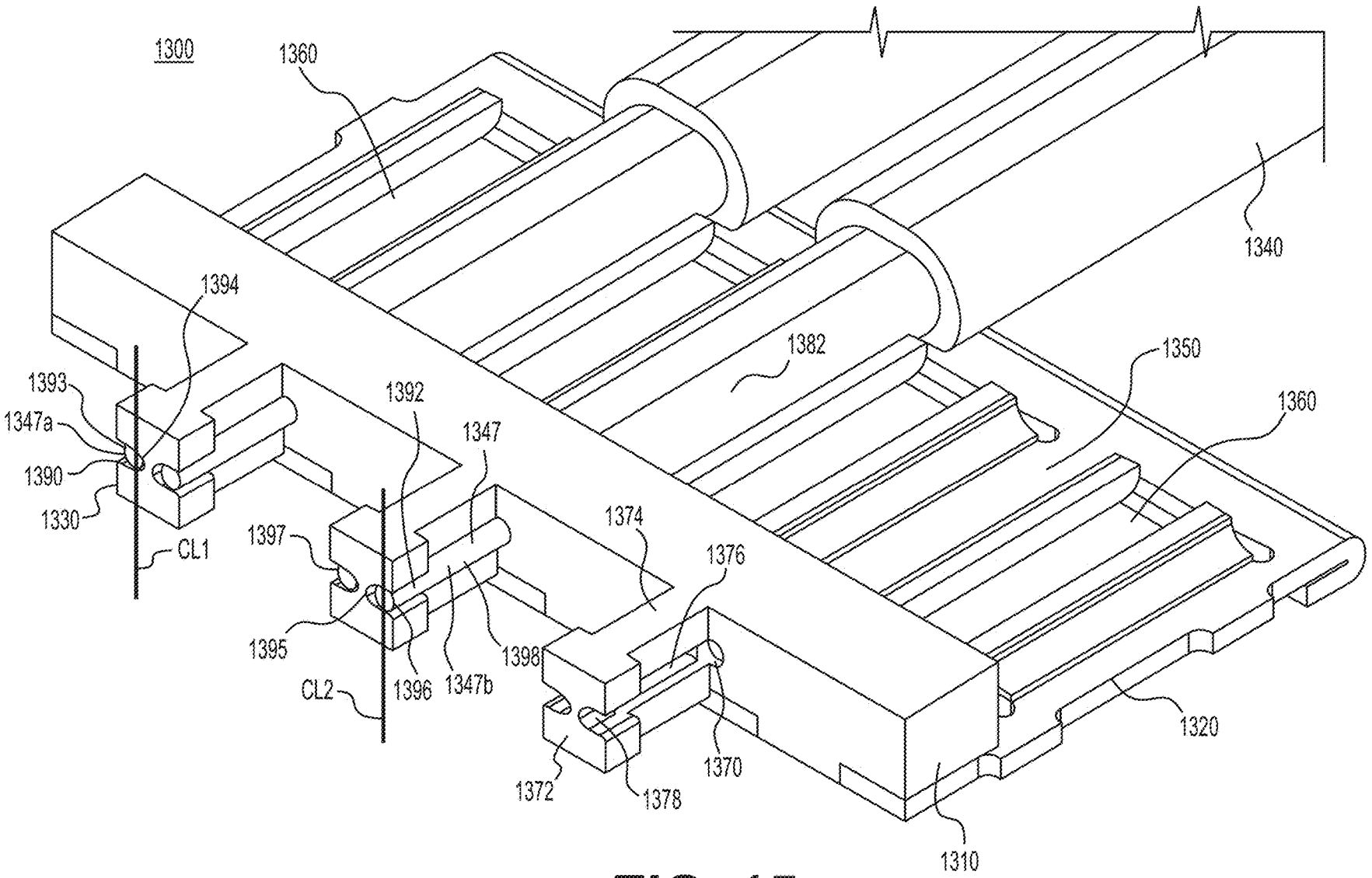
FIGS. 15 and 16 show a partially assembled cable connector of FIG. 13.

FIGS. 13-15 show a first or second cable connector 1300 that can be used with the board connector 110 of FIG. 3. The same type of first or second cable connector 1300 shown in FIGS. 13-15 can be used for either or both of the first and second cable connectors 120, 130 (shown in FIG. 1). The first or second cable connector 1300 can include at least one cable 1340, an insert 1310, and a connector shield 1320. Although FIGS. 13 and 14 show three cables 1340, any number of cables can be used.

Figure 20:
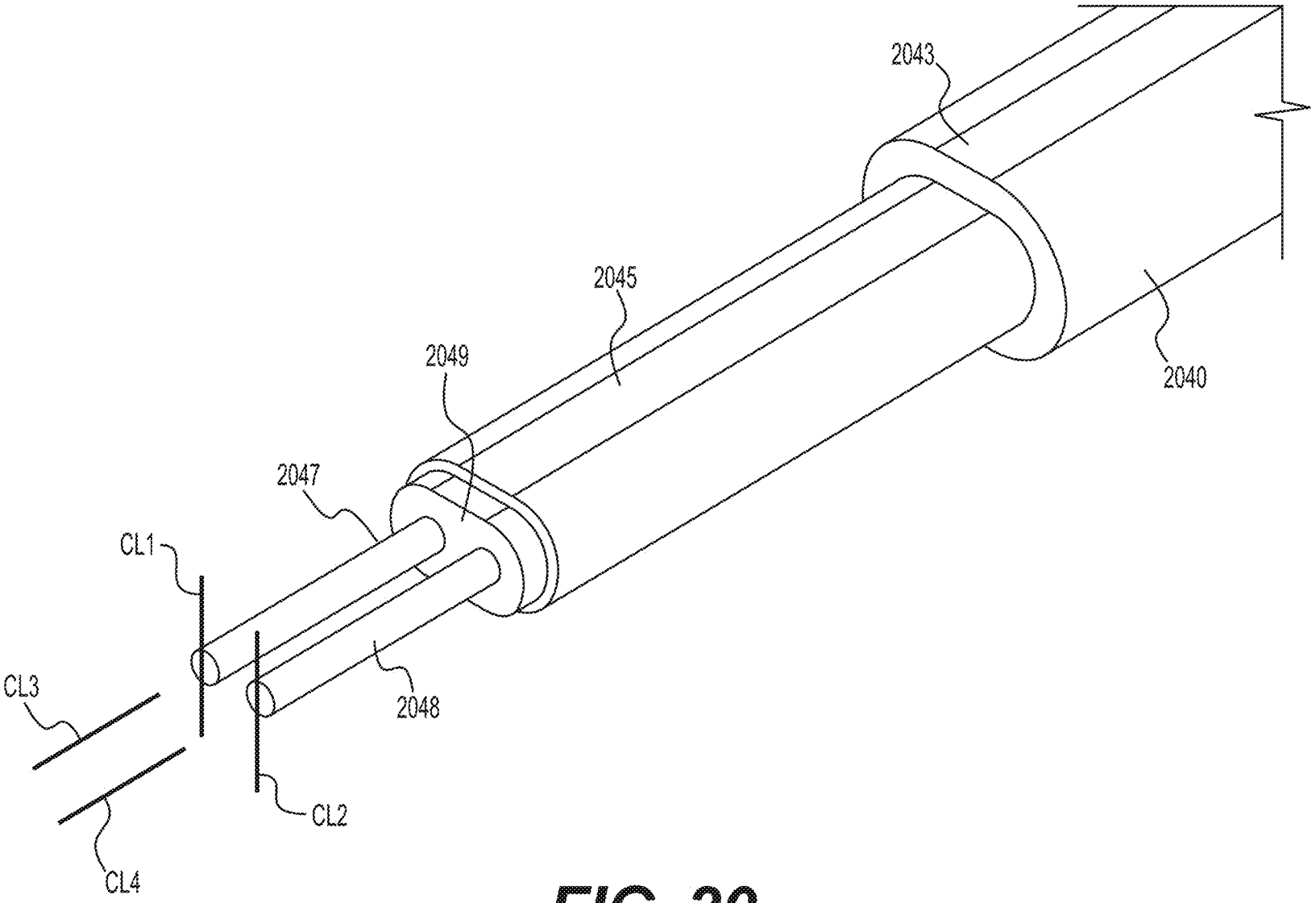
FIG. 20 shows a cable that can be used with the cable connector of FIG. 13.

The cable or cables 1340 can be similar to the cables 2040 shown in FIG. 20, but it is possible to use other suitable cables, including, for example, a coaxial cable with a single center conductor. The cable 2040 in FIG. 20 can be a twin axial, co-extruded, shielded differential signal pair cable that can include first and second cable conductors 2047, 2048 surround by a dielectric layer 2049, a cable shield 2045 surrounding the dielectric layer 2049, and a jacket 2043 surrounding the cable shield 2045. The respective first and second cable conductors 2047, 2048 and the cable shield 2045 of each cable 2040 can be exposed before being connected to the first or second cable connector 1300. Although not shown, the cable 2040 can include a drain wire in place of or in combination with the cable shield 2045.

The insert 1310 can be made from an electrically insulative material and can define at least one tooth or a plurality of teeth 1330. Each tooth 1330 can define a T-shape, with a cross-member 1372 and a base 1374. The cross-member 1372 can extend perpendicular or substantially perpendicular to the base 1374, can extend perpendicular or substantially perpendicular to the first and second cable conductors 1347*a*, 1347*b*, and lie substantially in a common plane with the base 1374. The base 1374 can be oriented perpendicular or substantially perpendicular to the cross-member 1372. The base 1374 can also be oriented parallel or substantially parallel to the first and second cable conductors 1347*a*, 1347*b*.

The insert 1310 can define at least one or a plurality of holes 1370 that each receive a respective one of the first and second cable conductors 1347*a*, 1347*b*. A hole 1370 can transition into a base recess 1376, such as a semi-circular recess in cross section, such that the hole 1370 and the base recess 1376 can receive a respective first or second cable conductor 1347*a*, 1347*b*. In turn, the base recess 1376 can transition into a cross-member recess 1378 that can also receive a respective one of a first or second cable conductor 1347*a*, 1347*b*.

The connector shield 1320 can define at least one or a plurality of grooves that can each receive a respective cable shield 1382 of a respective cable 1340. The cable shields 1382 can be electrically connected by the connector shield 1320. The connector shield 1320 can also define at least one or a plurality of slots 1360. Each slot 1360 can receive a respective ground blade 320 (shown in FIG. 1) of a board connector 110 (shown in FIG. 1), such that the connector shield 1320 can be electrically connected to a ground blade 320 (shown in FIG. 1).

FIG. 15 shows a first cable conductor 1347*a* and a second cable conductor 1347*b*. The first cable conductor 1347*a* can include a first mating end 1390, and the second cable conductor 1347*b* can include a second mating end 1392. The insert 1310 can carry the first mating end 1390 of the first cable conductor 1347*a* and the second mating end 1392 of the second cable conductor 1347*b*. A first centerline CL1 can divide the first mating end 1390 into a first semicircle and a second semicircle. A second centerline CL2 can divide the second mating end 1392 into a third semicircle 1395 and a fourth semicircle 1396. The first mating end 1390 and the second mating end 1392 can be a respective exposed first or second cable conductor 1347*a*, 1347*b*. The first semicircle 1393 of the first mating end 1390 can define a respective first contact surface 1397, and the fourth semicircle 1396 of the second mating end 1392 can define a respective second contact surface 1398. First and second contact surfaces 1397, 1398 can oppose each other. The first and fourth semicircles 1393, 1396 can each define flat surfaces, and are not strictly limited to arced or curved cross-sectional shapes.

Figure 16:
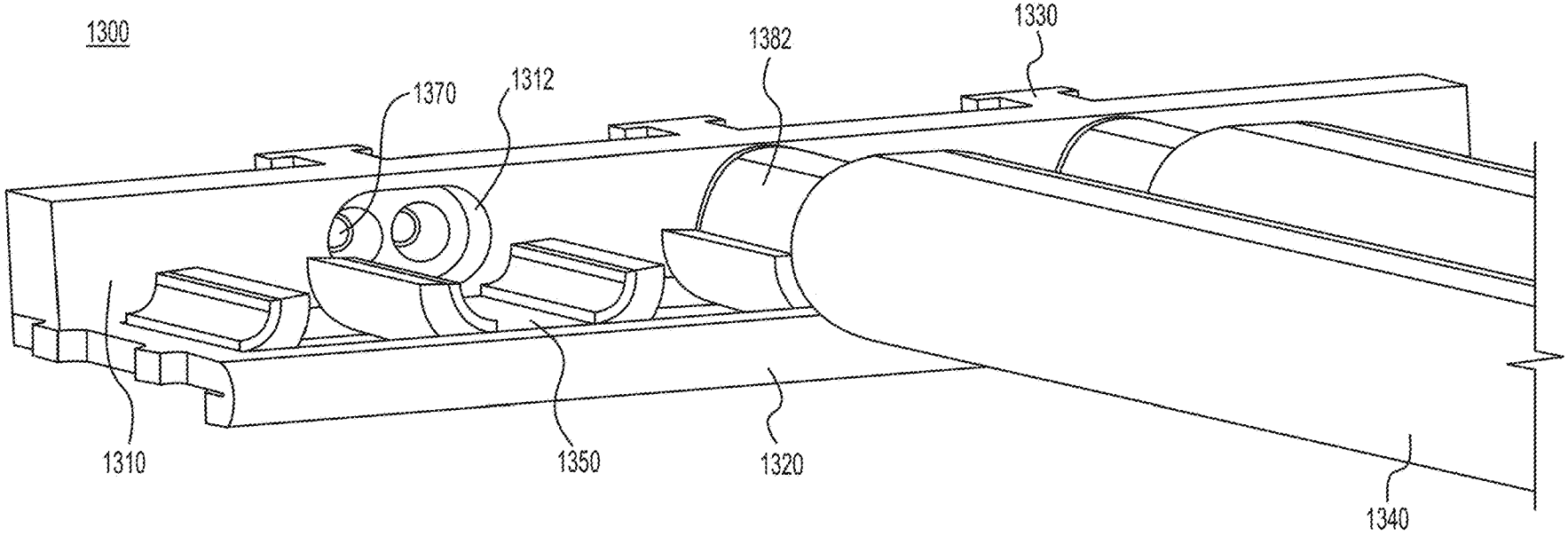

FIG. 16 shows an insert 1310 with teeth 1330. Countersunk recesses 1312 can each receive a respective cable 1340. A first or second cable conductor 1347*a*, 1347*b* can be inserted into a respective hole 1370 and extend into a respective tooth 1330. Cable shield 1382 can sit in a groove 1350 of connector shield 1320.

Figure 17:
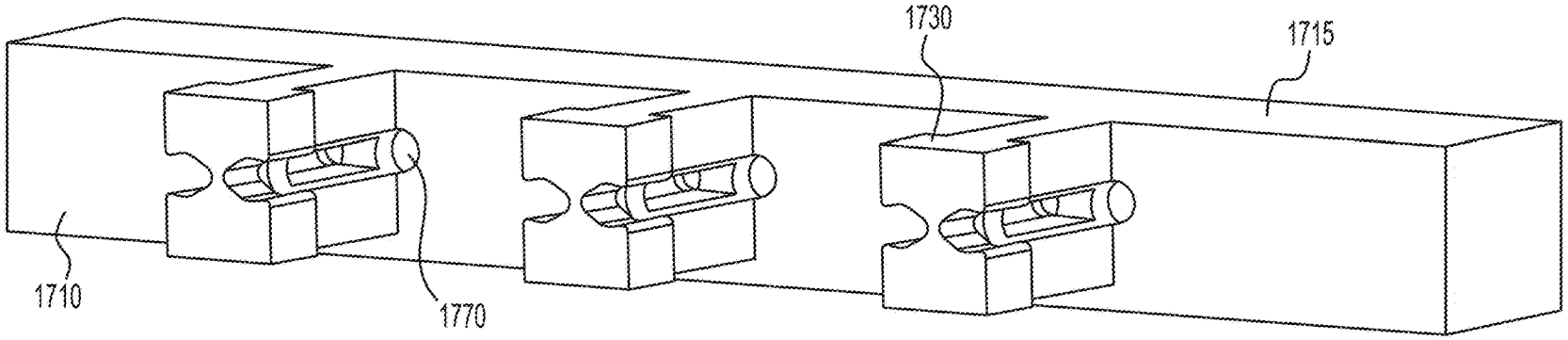
FIGS. 17 and 18 show an insert that can be used with the cable connector of FIG. 13.
Figure 18:
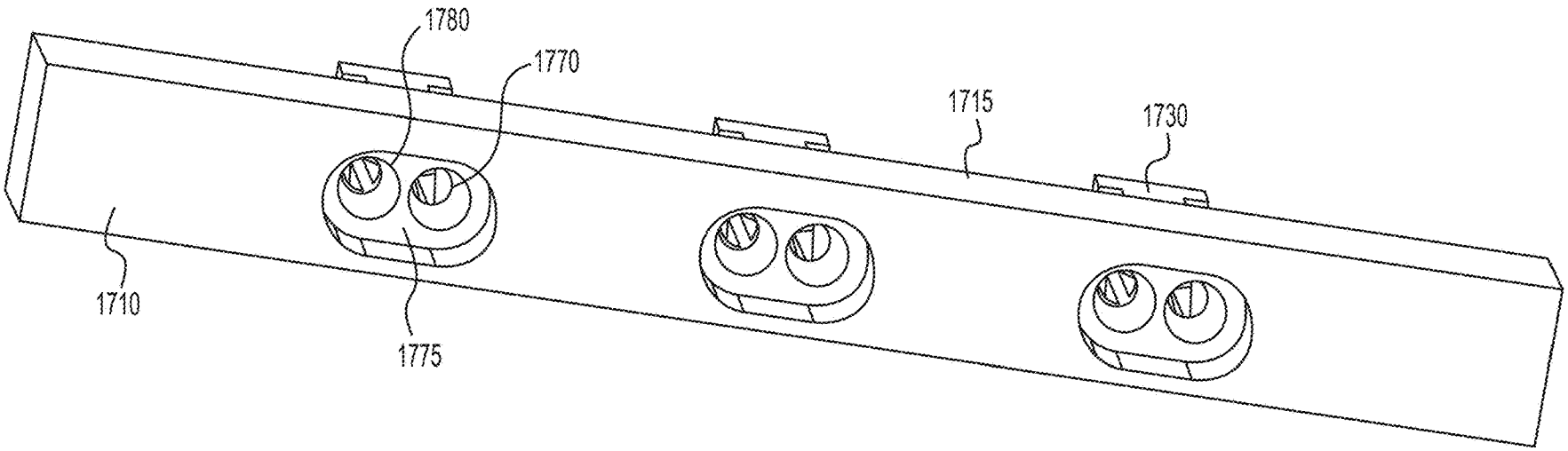

The insert 1710 is shown as separate from the connector shield in FIGS. 17 and 18. The insert 1710 can be made by insert molding an insert body 1715 around arms 1970 (shown in FIG. 19) of the connector shield 1900 (shown in FIG. 19) so that insert 1710 is integrally formed with the connector shield 1900 (shown in FIG. 19). The insert body 1715 can define through holes 1770 and with teeth 1730 aligned with the through holes 1770. As shown in FIGS. 17 and 18, the insert 1710 can include a counter-sunk hole 1775 into which the first and second cable conductors 1347*a*, 1347*b* (shown in FIG. 15), dielectric layer, and cable shield 1382 (shown in FIG. 15) can be inserted, and two additional counter-sunk holes 1780 (shown in FIG. 18) that receive only the first and second cable conductors 1347*a*, 1347*b* can be located in the counter-sunk hole 1775.

Once inserted into the through holes 1770 of the insert 1710, the first and second cable conductors 1347*a*, 1347*b* (shown in FIG. 15) can be secured to the end of the teeth 1730 by any suitable method. For example, the first and second cable conductors 1347*a*, 1347*b* (shown in FIG. 15) can be held in place by securing the dielectric layer to the insert 1710 by adhesive or holding the cable in place using an interference fit or securing medium between the groove 1350 (shown in FIG. 16) and the cable shield 1382 (shown in FIG. 16) of the cable 1340 (shown in FIG. 16). The teeth 1730 of the insert 1710 can secure the first and second cable conductors 1347*a*, 1347*b* (shown in FIG. 15) such that when the first cable connector 120 (shown in FIG. 1) and the second cable connector 130 (shown in FIG. 1) is attached to the board connector 110 (shown in FIG. 1), a respective head 1110, 1210 (shown in FIGS. 11 and 12) or opposing contact surfaces 1212 of a respective electrical contact 1100, 1200 (shown in FIGS. 11 and 12) of the board connector 110 (shown in FIG. 1) engage only one side of a corresponding first cable conductor 1347*a*, such as first contact surface 1397 on the first semicircle 1393, and only engage on one side of a corresponding second cable conductor 1347*b* on the fourth semicircle 1396 (shown in FIG. 15.

Figure 19:
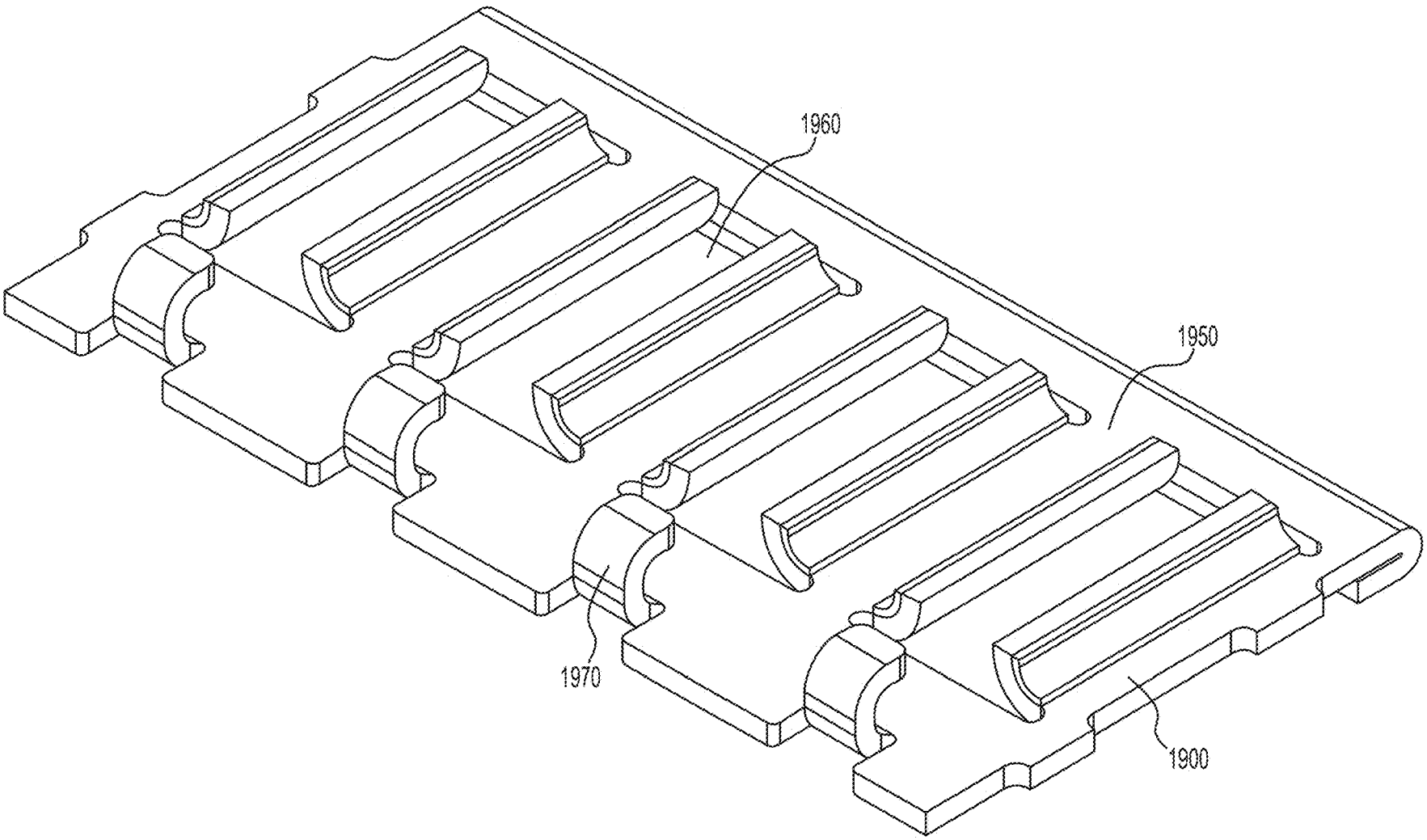
FIG. 19 shows a connector shield that can be used with the cable connector of FIG. 13.

As shown in FIG. 19, the connector shield 1900 can include grooves 1950 that can receive the cable shield 1382 (shown in FIG. 13) of a corresponding cable 1340 (shown in FIG. 13). Slots 1960 can receive the first and second springs 930*a*, 930*b* (shown in FIG. 9) of the ground blade 900 in the board connector 110 (shown in FIG. 1), and arms 1970 about which the insert 1310 (shown in FIG. 13) can be made, for example, by insert molding. The cable shield 1382 (shown in FIG. 13) of the cable 1340 (shown in FIG. 13) can be attached to the groove 1950 by any suitable method, including, for example, by soldering the cable shield 1382 (shown in FIG. 13) of the cable 1340 (shown in FIG. 13) to the groove 1950. The connector shield 1900 can be made, for example, by stamping a flat metal sheet.

FIG. 20 is perspective view of a co-extruded twin axial cable 2040. The cable 2040 can include an electrically insulative jacket 2043; a cable shield 245 that can be wrapped copper, a braid, or other electrically conductive material; a first cable conductor 2047; a second cable conductor 2048; and a dielectric layer 2049 positioned between the first cable conductor 2047 and the cable shield 245. First centerline CL1 extends perpendicular or substantially perpendicular to third longitudinal centerline CL3, with the first cable conductor 2047 extending along the third longitudinal centerline CL3. Second centerline CL2 extends perpendicular or substantially perpendicular to fourth longitudinal centerline CL4. The second cable conductor 2048 extends along the fourth longitudinal centerline CL4. The first and second centerlines CL1, CL2 can be parallel to each other. Third and fourth longitudinal centerlines CL3, CL4 can be parallel to each other.

Figure 21:
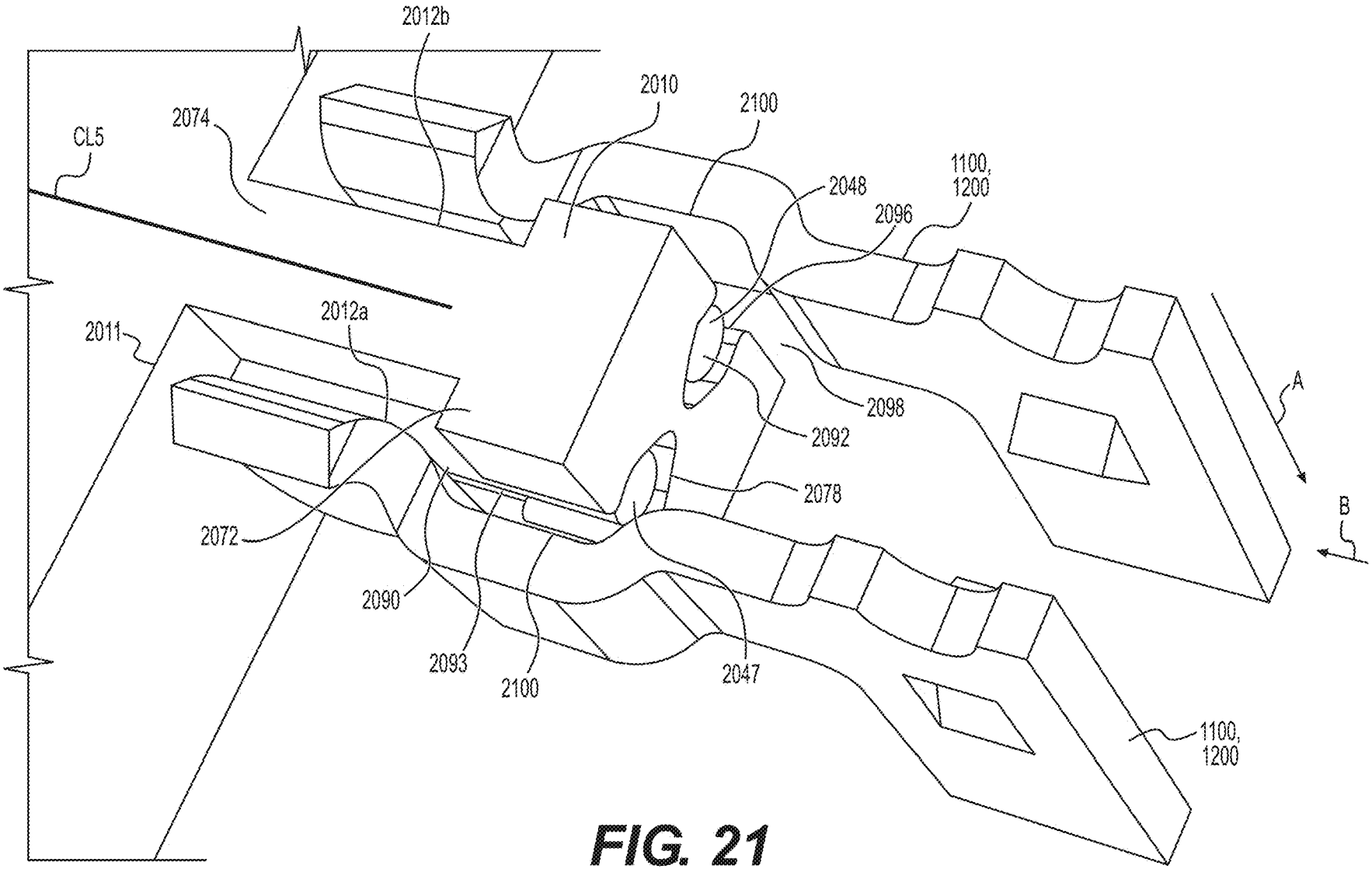
FIG. 21 shows a close-up view of a tooth and contacts of the cable connector system shown in FIG. 1.

FIG. 21 is a close-up view of a tooth 2010 of first and second cable connector 120, 130 (shown in FIG. 1) and the electrical contacts 1100, 1200 of the board connector 110 (shown in FIG. 1). Each respective first and second cable conductor 2047, 2048 can direct and physically contact a corresponding electrical contact 1100, 1200. Only one side, such as first semicircle 2093 or fourth semicircle 2096 of the respective first mating end 2090 or second mating end 2092 of the respective first cable conductor 2047 or second cable conductor 2048 is contacted by a respective opposing surface of a corresponding electrical contact. For example, one opposing surface of a pair of opposing surfaces, such as first contact surface 2012*a*, can be electrically connected to only a first semicircle 2093 surface of the first mating end 2090 of the first cable conductor 2047. Another opposing surface of a pair of opposing surfaces, such as second contact surface 2012*b*, can be electrically connected to only a fourth semicircle 2096 surface of the second mating end 2092 of the respective second cable conductor 2048.

The electrical contacts 1100, 1200 can each define a respective contact recess 2100, such that the contact recesses 2100 are mirror images of each other about fifth longitudinal centerline CL5. The combined respective contact recesses 2100 can define a tooth recess 2098 that can receive a corresponding tooth 2010 or a cross-member 2072 of a tooth 2010. Electrical contacts 1100, 1200 can connect electrically with a corresponding first mating end 2090 or second mating end 2092 of a respective first cable conductor 2047 or a second cable conductor 2048, only at a position along the base 2074 of the tooth 2010, such as between a body of the insert 2011 and the cross member 2072. The cross member 2072 can be sized and shaped to extend over the first and fourth semicircles 2093, 2096 to physically prevent the electrical contacts 1100, 1200 for physically or electrically contacting respective first and second cable conductors 2047, 2048 positioned in a corresponding cross member recess 2078. Each tooth 2010 can be inserted between two opposed, immediately adjacent, facing, corresponding electrical contacts 1100, 1200 in direction A, which is perpendicular or substantially perpendicular to the fifth longitudinal centerline CL5. Alternatively, each tooth 2010 can be inserted between two opposed, immediately adjacent, facing corresponding electrical contacts 1100, 1200 in direction B, which is parallel to the fifth longitudinal centerline CL5 and perpendicular or substantially perpendicular to direction A.

Figure 22:
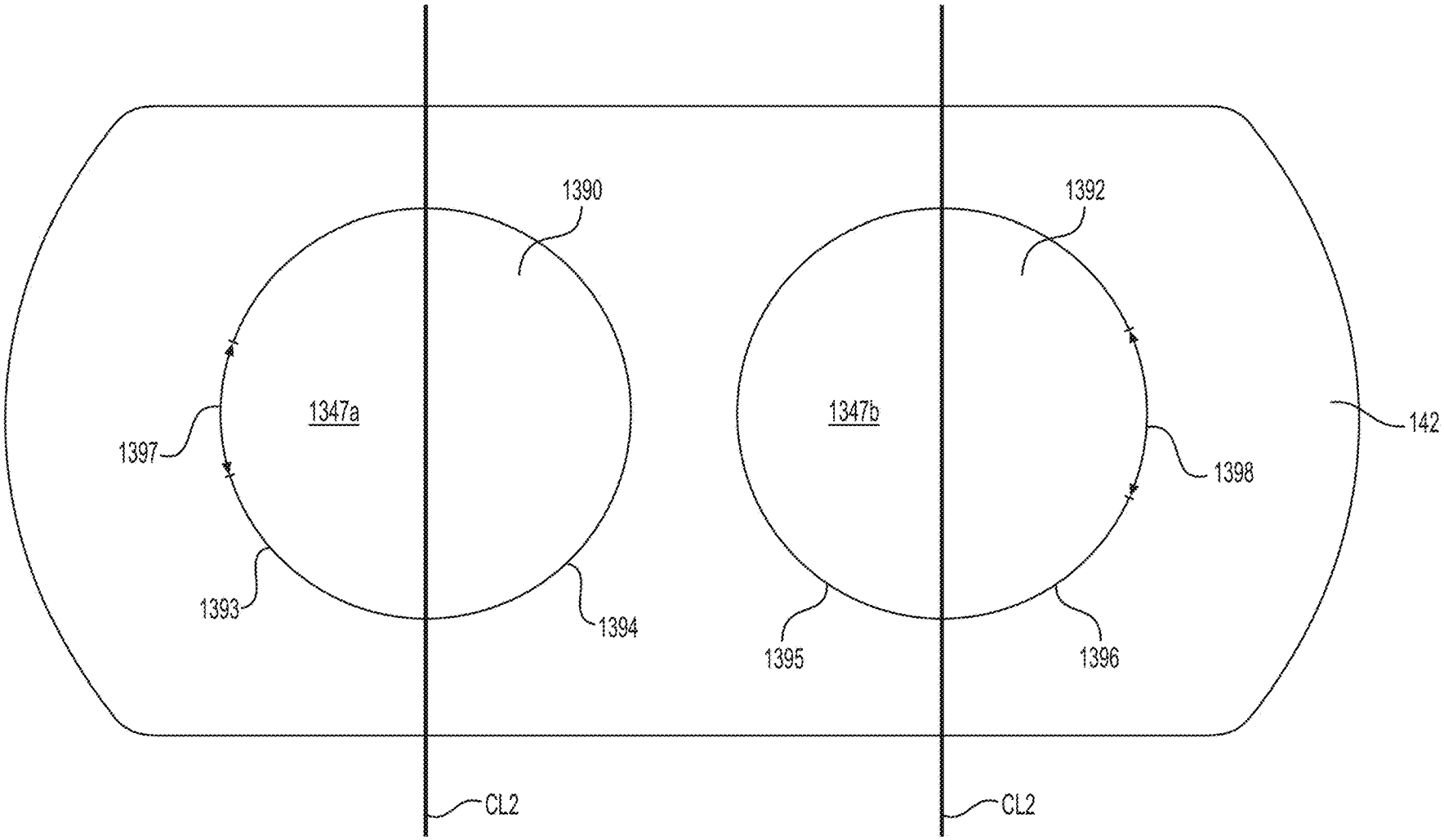
FIG. 22 shows a cross-section of the cable shown in FIG. 20 with a cable shield and jacket removed for clarity.

As shown in FIG. 22, if an imaginary line such as centerline CL1 or centerline CL2 divides the cross-section of a center conductor such as first cable conductor 1347*a* or second cable conductor 1347*b* into four semicircles, such as first semicircle 1393, second semicircle 1394, third semicircle 1395, and fourth semicircle 1396, then only one of the semicircles is contacted by a corresponding electrical contact. First semicircle 1393 can define a first contact surface 1397 that electrically contacts a corresponding electrical contact 1100, 1200 (shown in FIGS. 11 and 12). Fourth semicircle 1396 can define a second contact surface 1398 that electrically contacts a corresponding electrical contact 1100, 1200 (shown in FIGS. 11 and 12). The first and second cable conductors 1347*a*, 1347*b* can be partially or completely surrounded by electrical insulator 142. A cable shield and jacket are not shown, for clarity. Second and third semicircles 1394, 1395 can be configured not to physically touch a corresponding electrical contact 1100, 1200 (shown in FIGS. 11 and 12).

Figure 23:
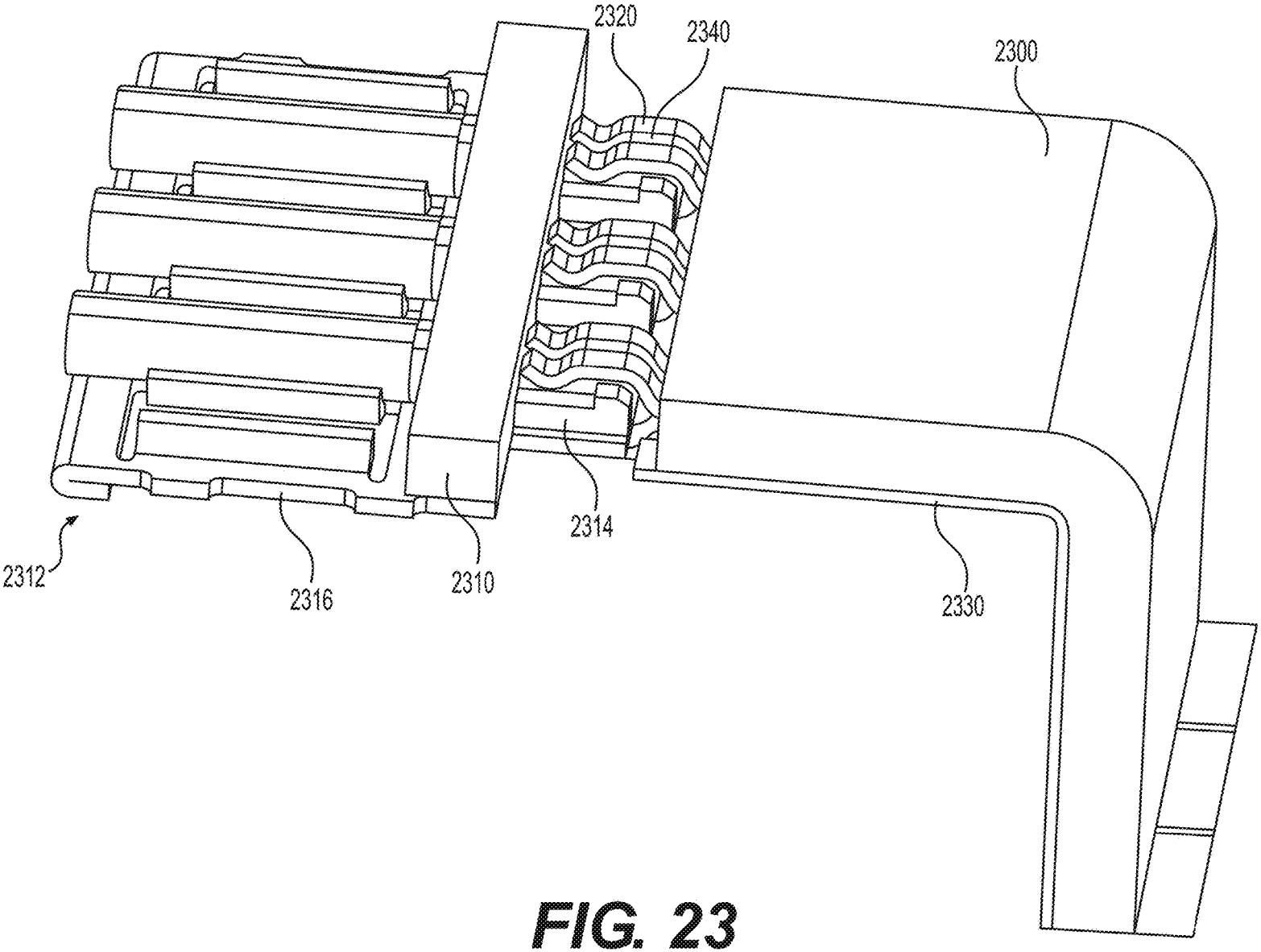
FIG. 23 is a perspective, side view of a connector system according to a second embodiment.

FIG. 23 shows another embodiment of a third cable connector 2310 connected to a wafer 2300. The cable connector of FIG. 23 is similar to the first or second cable connector 1300 of FIG. 13. One difference is that insert 2312 of the third cable connector 2310 of FIG. 23 includes different teeth 2314. Another difference is that the connector shield 2316 of the third cable connector 2310 of FIG. 23 extends under the teeth 2314 of the insert 2312. Electrical contacts 2320 do not have mating surfaces that oppose each other. A web 2340 of dielectric material may be positioned between two electrical contacts 2320 of a differential signal pair. A ground plane 2330 of the board connector wafer 2300 can extend from a mounting interface of the wafer to a mating interface of the wafer 2300.

Figure 24:
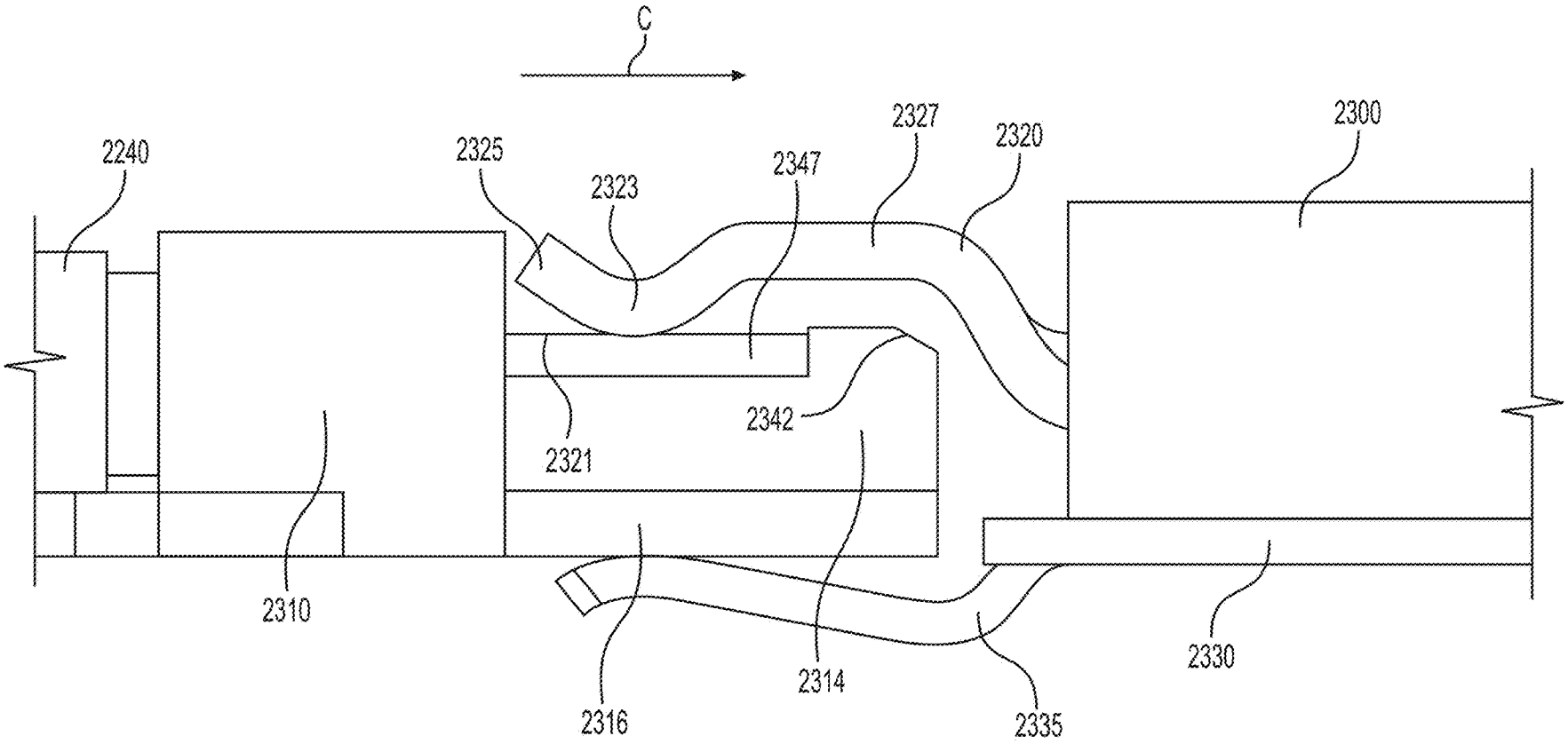
FIG. 24 is a side view of the connector system shown in FIG. 23.

As shown in FIG. 24, a first cable conductor 2347 of the cable 2350 can be held by a tooth 2314 such that a top portion 2321 of first cable conductor 2347 is exposed, i.e. the insulation layer, cable shield, and jacket are removed or the cable is devoid of an insulation layer, cable shield, and jacket adjacent to the exposed first cable conductor 2347. The same is true for a second cable conductor (not shown). The wafer 2300 can include contact pairs, such a differential signal pairs. The ground plane 2330 of the wafer 2300 can include ground arms 2335 that engage with the connector shield 2316 of the third cable connector 2310. Any number of ground arms 2335 can be used. The electrical contacts 2320 of the wafer 2300 contact the top portion 2321 of the first cable conductor 2347 (and the second cable conductor) of the third cable connector 2310. Although not shown, two or more wafers 2300 can be included in or define a board connector, similar to the board connector 310 of FIG. 4. Each wafer 2300 can be right angled, which allows the ground plane 2330 to extend the entire or almost the entire length of the electrical contacts 2320.

Each electrical contact 2320 can be cantilevered, including a head 2323 and tail (not shown) that are connected at 90° or approximately 90° within manufacturing tolerances. The heads 2323 in pairs of electrical contacts 2320 can only electrically connect, physically touch, or both, the top portion 2321 of a respective first cable conductor 2347 (and second cable conductor) of the cable 2350. The heads 2323 can include a lead-in 2325 and a bend 2327 to assist with mating with the first cable conductor 2347 (and the second cable conductor) of the cables 2350 with the corresponding electrical contacts 2320 of the wafer 2300. The lead-ins 2325 can assist in guiding the teeth 2314 of the third cable connector 2310 when the third cable connectors 2310 are mated with corresponding wafers 2300. The bend 2327 can be shaped to accommodate an end 2342 of a corresponding tooth 2314. The third cable connector 2310 can be mated with a corresponding wafer 2300 by pushing the third cable connector 2310 toward the wafer 2300 parallel to direction C. The tail (not shown) can be surface mounted to a substrate. Alternatively, the tail can include a press-fit tail, a through-hole tail, or any other suitable structure to attach the electrical contacts 2320 to the substrate.

Figure 25:
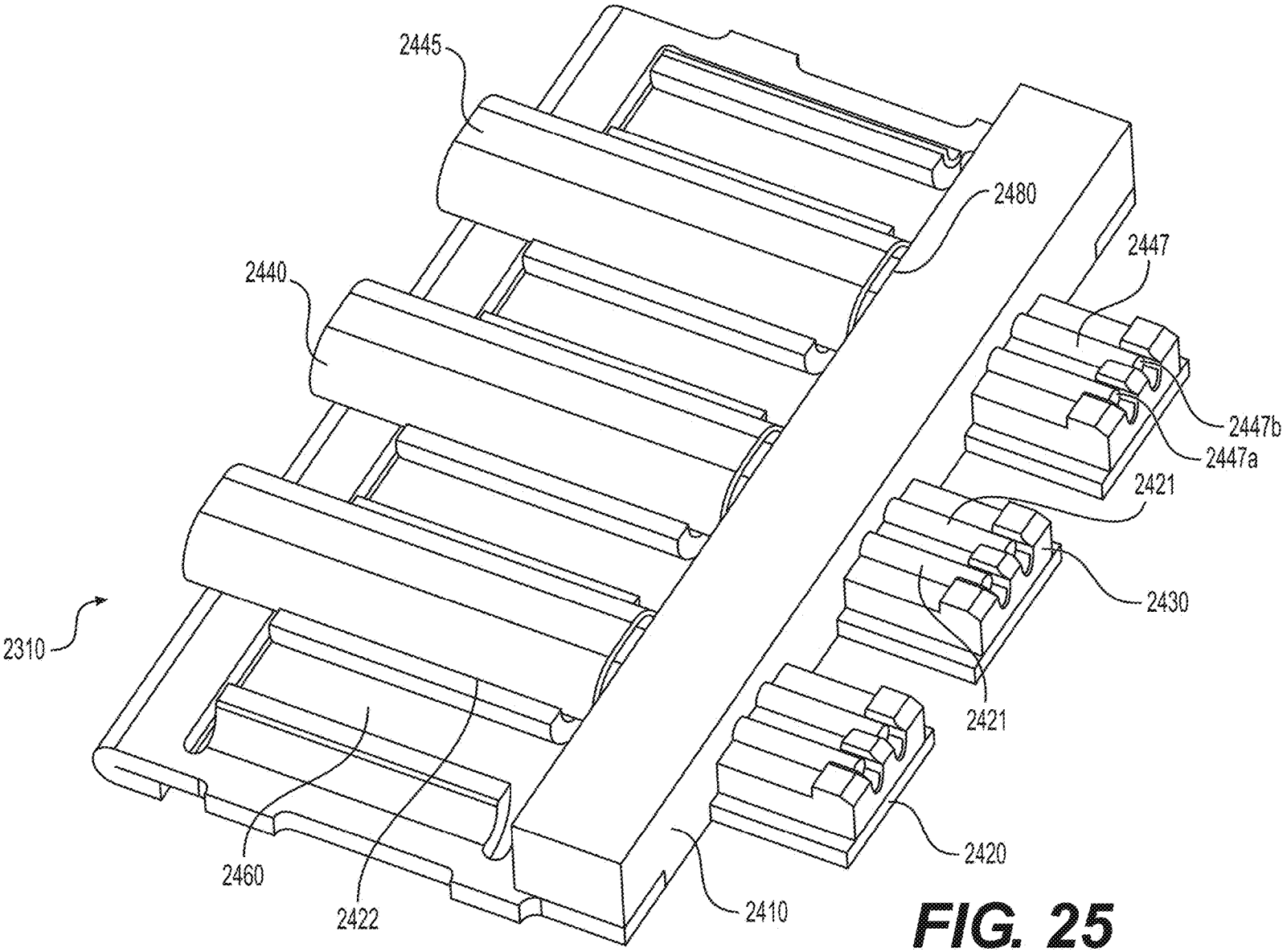
FIG. 25 shows the cable connector shown in FIGS. 23 and 24.

FIG. 25 shows the third cable connector 2310 shown in FIGS. 23 and 24. The third cable connector 2310 is essentially the same as the cable connectors described above, but the teeth 2430 are different. Third cable connector 2310 can include cables 2440, an insert 2410, and a connector shield 2420. Although FIG. 25 shows three differential signal cables, any number of cables 2440 can be used. The cable 2440 can be a twin axial cable as shown in FIG. 20, but it is possible to use other suitable cables, including, for example, a coaxial cable with a single center conductor. FIG. 24 only shows a portion of the cables 2440 with the exposed cable shield 2445, but the cables 2440 in FIG. 25 would typically also include a jacket on the portions not shown in FIG. 24. First and second cable conductors 2447*a*, 2447*b* are shown, with respective exposed top portions 2321. The connector shield 2420 can include grooves 2422 that receive respective cable shields 2445 of the cables 2440, at least one or a plurality of slots 2460, and arms (not shown) about which the insert 2410 can be made, for example, by insert molding. The cable shield 2445 can be attached to a respective groove 2422 by any suitable method, including, for example, by soldering the cable shield 2445 to the groove 2422. The connector shield 2420 can be made, for example, by stamping a flat metal sheet.

Once inserted into the insert 2410, first cable conductor 2447*a* and second cable conductor 2447*b* can be secured to the end of the teeth 2430 by any suitable method. For example, first and second cable conductors 2447*a*, 2447*b* can be held in place by securing the dielectric layer 2480 to the insert 2410 by adhesive or holding the cable 2440 in place using an interference fit or securing medium. The teeth 2430 of the insert 2410 can secure the first and second cable conductors 2447*a*, 2447*b* such that when the third cable connector 2310 is attached to a wafer of a board connector (not shown), the corresponding heads of the electrical contacts of the board connector engage only one side or only the respective top portions 2321 of the first and second cable conductors 2447*a*, 2447*b*.

Figure 26:
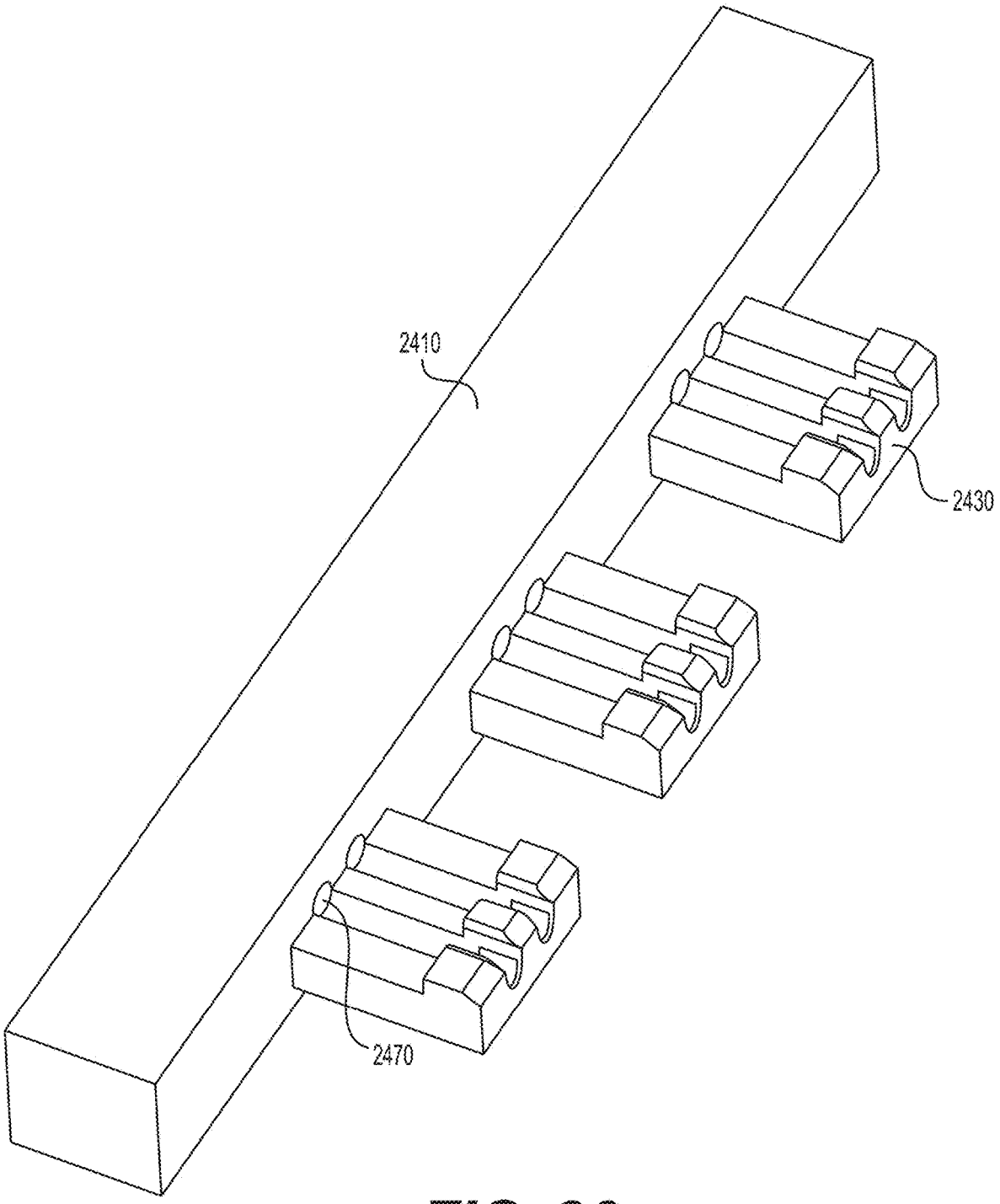
FIG. 26 shows the insert used in the cable connector shown in FIGS. 23-25.

Although the insert 2410 of the third cable connector 2310 is shown without a connector shield in FIG. 26, the insert 2410 can be made by insert molding the insert 2410 around ground plane arms of a connector shield, similar to FIG. 19, so that insert 2410 is integrally formed with the connector shield. The insert 2410 can include a body that defines holes 2470 and with teeth 2430 aligned with the holes 2470. As with the insert shown in FIG. 18, the insert 2410 shown in FIG. 26 can include a countersunk hole (not shown) into which center conductors, dielectric layer, and shield can be inserted, and two additional countersunk holes that each receive only a respective one of the center conductors.

Figure 27:
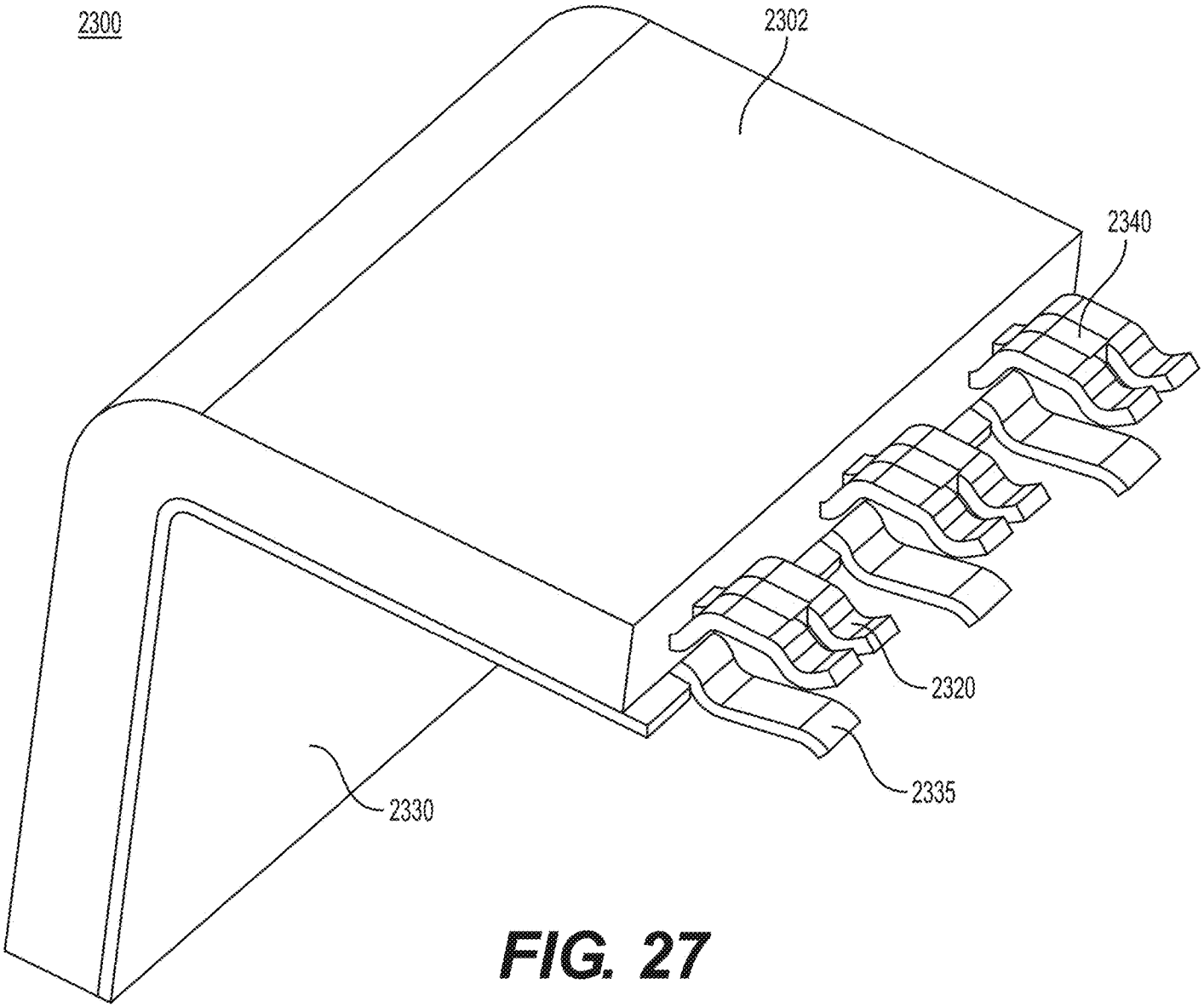
FIG. 27 shows the wafer shown in FIG. 23.

FIG. 27 shows a wafer 2300 shown in FIGS. 22 and 23. The wafer 2300 can include electrical contacts 2320 embedded in a wafer body 2302 and a ground plane 2330 attached to a bottom surface of the wafer body 2302, or the right angle surface of the wafer body 2302 with the shorter mating-to-mounting interface length. The wafer body 2302 can be made from an electrically dielectric material. A web 2340 can extend from the wafer body 2302 in between the pairs of electrical contacts 2320. The wafer 2300 can be made by insert molding the wafer body 2302 around the electrical contacts 2320 so that wafer body 2302 is integrally formed with the electrical contacts 2320. The wafer 2300 can include three or more pairs of differential signal electrical contacts 2320, but any number of contact pairs can be used. The ground arms 2335 of the ground plane 2330 can extend from the ground plane 2330 underneath the pairs of electrical contacts 2320. The ground plane 2330 can include three ground arms 2335, but any number of ground arms 2335 can be used. Different height wafers 2300 can be used to connect to first and second cable connectors, with the wafer 2300 connecting to the first cable connector being taller than a wafer connecting to the second cable connector. Wafers 2300 can be stepped in a mating direction.

Figure 28:
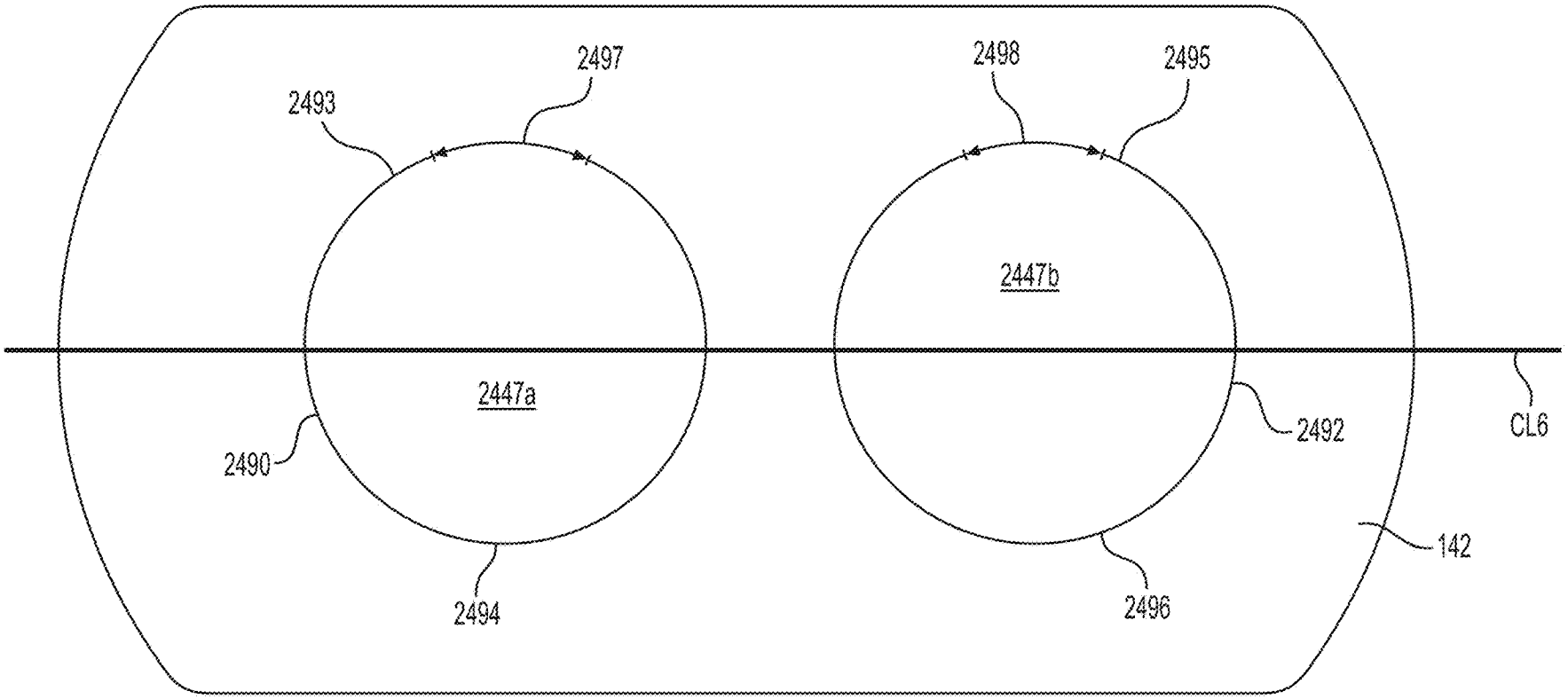
FIG. 28 is a cross-section of the cable shown in FIG. 20 and FIG. 25 with a cable shield and jacket removed for clarity.

As shown in FIG. 28, fifth centerline CL5 passes through midpoints of two adjacent, cross-sectioned center conductors, such as first cable conductor 2447*a* or second cable conductor 2447*b*. The fifth centerline CL5 divides the first and second cable conductors 2447*a*, 2447*b* into four semicircles, such as first semicircle 2493, second semicircle 2494, third semicircle 2496 and fourth semicircle 2496. First semicircle 2493 can define a first contact surface 2497 that electrically contacts a corresponding electrical contact 1100, 1200 (shown in FIGS. 11 and 12). Fourth semicircle 2496 can define a second contact surface 2498 that electrically contacts a corresponding electrical contact 1100, 1200 (shown in FIGS. 11 and 12). The first and second cable conductors 2447*a*, 2447*b* can be partially or completely surrounded by electrical insulator 142. A cable shield and jacket are not shown for clarity. Second and fourth semicircles 2494, 2496 can be configured not to electrically or physically contact a corresponding electrical contact 1100, 1200 (shown in FIGS. 11 and 12).

Figure 29:
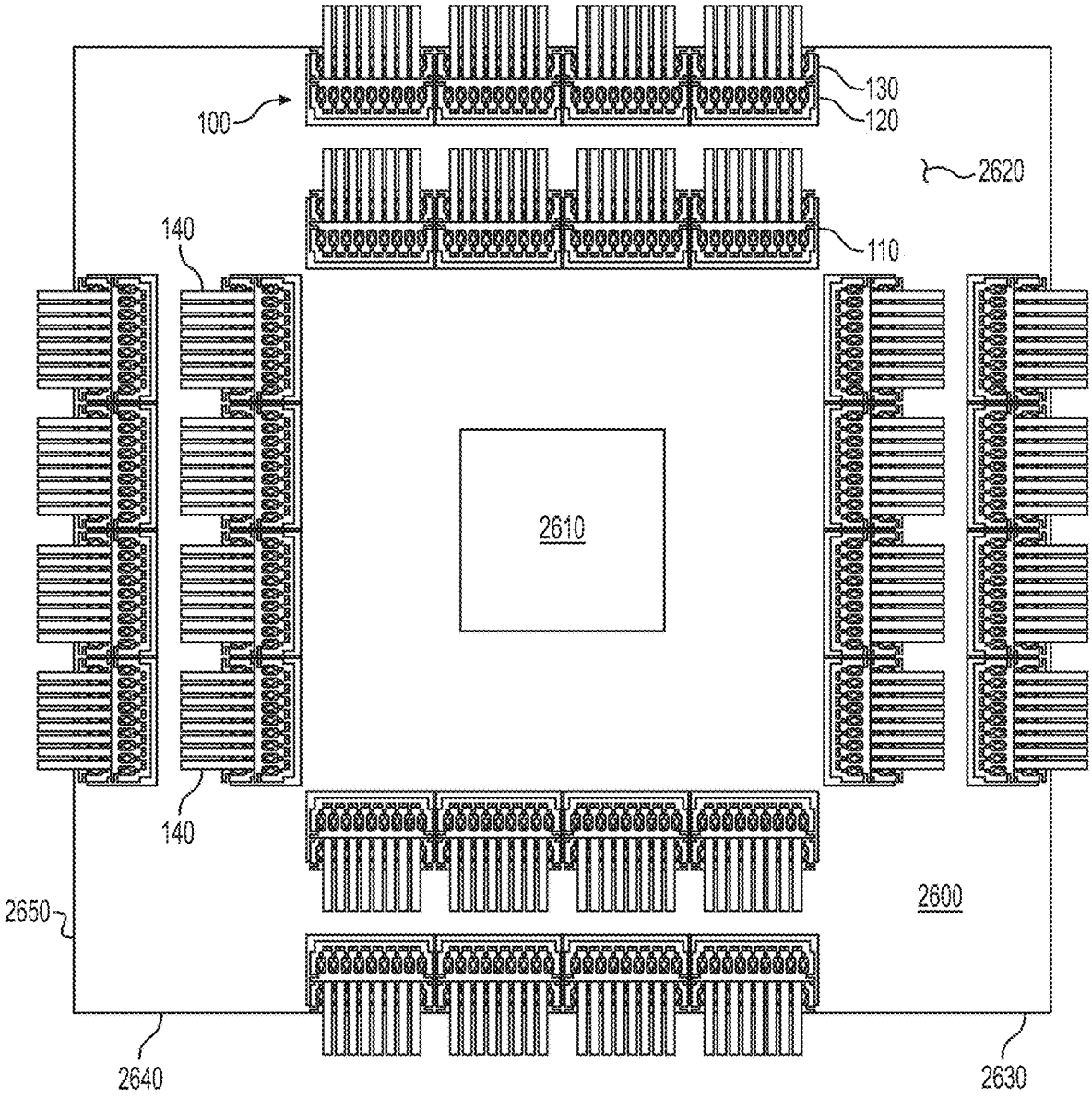
FIG. 29 is a top view of a die package.

FIG. 29 shows a first substrate 2600, a die 2610, and a first group of a plurality of connector systems 100, a first group of a plurality of board connectors 110, or a first group of first and second cable connectors 120, 130. The die 2610 can also be a chip and can be carried on a first package surface 2620 of the first substrate 2600. The combination of the first substrate 2600 and the die 2610 can be referred to as a die package 2630. The first package surface 2620 may carry optional SERDES (serializer/deserializer) chips (not shown), and a plurality of board connectors 110 or a plurality of connector systems 100 that are each a combination of a board connector 110 and a first cable connector 120, second cable connector 130, or any of the cable connector embodiments shown in any one of FIGS. 1-28. The SERDES chips can include 16-by-16-lanes each, or any suitable number of lanes. The board connectors 110 or first or second cable connector 120, 130 are in electrical contact with the die. Placing the board connectors 110, the connector systems 100, or the first cable connector 120 directly on the die package 2630 helps to eliminate trace losses from the die package 2630 to a host substrate (not shown).

The first substrate 2600 can be approximately 145-mm-by-145-mm, such as a printed circuit board, measured along two intersecting first and second die edges 2640, 2650 of the first substrate 2600. The first substrate 2600 can be other sizes too, such as a 70-mm-by-70-mm, an 85-mm-by-85-mm die package, a 120-mm-by-120-mm die package, a 145-mm-by-145-mm die package, a 150-mm-by-150-mm die package, a 230-mm-by-230-mm die package, or other sized die package. The die package is preferably square, but does not have to have sides of equal lengths and can have other shapes. The larger the area of the first substrate 2600, the more connector systems 100 can be added to the first package surface 2620 or the second package surface 2660.

Figure 30:
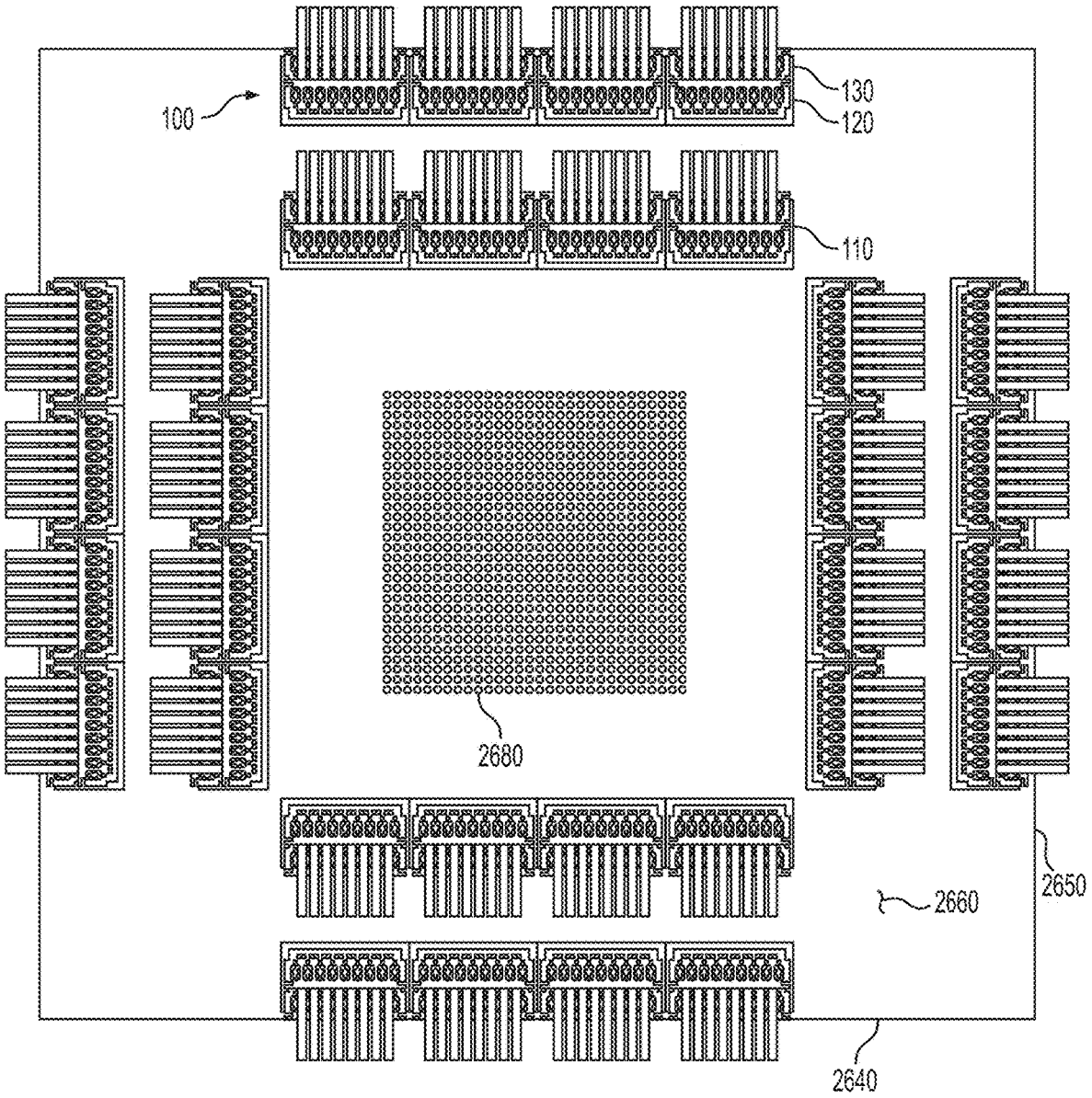
FIG. 30 is a bottom perspective view of the die package shown in FIG. 29.

FIG. 30 shows a second package surface 2660 of the die package 2630. The second package surface 2660 can include a second group of a plurality of board connectors 110 or a plurality of connector systems 100 that are each a combination of a board connector 110 and a first cable connector 120, second cable connector 130, or any of the cable connector embodiments shown in any one of FIGS. 1-28. At least one of the board connector 110 or the first or second cable connectors 120, 130 are electrically connected to the die 2610. The second package surface 2660 can also define a pin or pad field 2680 that is electrically connected to the die 2610 and can mate electrically with a power source, compression connector, pin connector, interposer, etc. (not shown). The compression or pin connector can exclusively carry power, control, or other sideband signals to the die 2610 or can carry high-speed signals as well. The second package surface 2660 of the die package 2630 can include SERDES (serializer/deserializer) chips, such as 16-by-16 lane SERDES chips. First and second die edges 2640, 2650 can have the same respective lengths or can have different lengths.

The die package 2630 can therefore include a first substrate 2600 that defines a first package surface 2620; a second, opposed package surface 2660; a die 2610 carried by the first package surface 2620; differential signal connector systems 100 carried by the first package surface 2620; and differential signal connector systems 100 carried by the second package surface 2660. Each differential signal connector system 100 can include a board connector 110 carried by the first package surface 2620, a board connector 110 carried by the second package surface 2660, and a first cable connector 120 or a second cable connector 130 releasably attached to each of the board connectors 110.

The electrical connectors can each include one, two, three, or four rows of four differential signal pairs, or any other number of rows, contacts, or differential pairs. FIG. 29 shows a 145-mm-by-145-mm die package, with the first package surface 2620 populated with die 2610 and thirty-two of the two-row connector systems 100 shown in FIGS. 1-22. Each first cable connector 120 can include eight differential signal cables 140, and each second cable connector 130 can include eight differential signal cables 140, or a total of sixteen differential signal cables per each two-row connector system 100. As shown on a 145-mm-by-145-mm die package 2630, thirty-two of the two-row connector systems 100 provide 512 differential signal pairs on the first package surface 2620 of the die package 2630. FIG. 30 shows an additional 512 differential signal pairs can be positioned on a second package surface 2660 of the die package 2630, which provides a total of 1024 differential pairs or 2048 individual cables 140 or 512 lanes per die package 2630. At a 56 GHz NRZ or 112 GHz PAM4 compliant signal, 1024 differential pairs will facilitate transmission of approximately 50 terabytes of data per second. Two row connector systems 100, as shown in FIGS. 29 and 30, can have a simulated insertion loss of approximately 0 dB to −0.5 dB for frequencies from 0 GHz to 28 GHz. Return loss can be under −15 dB through frequencies up to and including approximately 30 GHz. Near end crosstalk can be under −50 dB through frequencies up to and including approximately 30 GHz.

Figure 31:
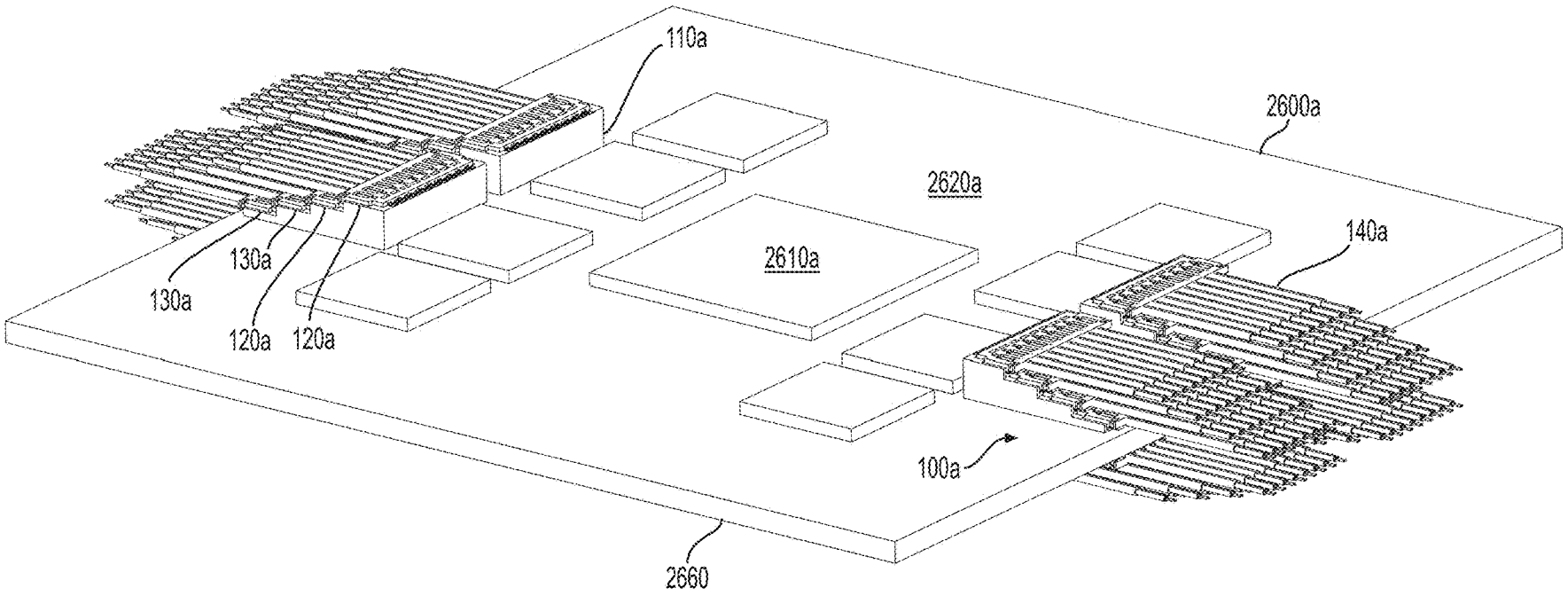
FIG. 31 is a perspective side view of a die package and connector systems according to a third embodiment.

Four row connector systems 100*a* are shown in FIG. 31. Each connector system 100*a* can include a board connector 110*a*, two first cable connectors 120*a*, and two second cable connectors 130*a*. Since first and second cable connectors 120*a*, 130*a* are interchangeable, the board connector 100*a* can be populated with only first cable connectors 120*a*, only second cable connectors 130*a*, or any mixture of the two. The connector systems 100*a* are positioned around a die 2610*a* on a first substrate 2600*a*.

With four rows of eight differential signal pairs per electrical connector system 100*a*, thirty-two twin axial cables or sixty-four single conductor cables 140*a* can be connected to a corresponding one of the board connectors 110*a* carried by any one of the first package surface 2620 of the die package or the second package surface 2660 of the die package 2630. FIG. 31 shows four connector systems 100*a* on each of the first and second package surfaces 2620, 2660, but other numbers of connector systems 100*a* can be used. For example, if the die package 2630 shown in FIG. 31 is 145-mm-by-145-mm, four of the thirty-two pair connector systems 100*a* can fit along each side of the first package surface 2620 and along each side of the second package surface 2660. This yields the same number of differential signal pairs and channels as the embodiments described and shown with respect to FIGS. 29 and 30. The first package surface 2620 of the die package 2630 can include at least 1025 twin axial pairs or approximately 2048 individual cable conductors. If the die package 2630 shown in FIG. 31 is a 70-mm-by-70-mm die package 2630, three of the thirty-two pair connector systems 100*a* can fit along each side of the first package surface 2620 and along each side of the second package surface 2660. This configuration yields at least 768 differential, twin axial pairs or at least 1536 individual cables. With thirty two differential cables per connector system, a 70-mm-by-70-mm die package can support an approximate 37.5 terabyte/sec transmission rate at a 56 GHz NRZ or 112 GHz PAM4 compliant data or signal rate. For 50 Tb/sec throughput, a first substrate 2600 larger than 70-mm-by-70-mm may be needed.

One row connector system (not shown) can be approximately 1.5 mm in height. A two row connector system 100 can be approximately 3 mm in height. A three row connector system (not shown) can be approximately 4.5 mm in height. A four row connector system can be approximately 6 mm in height. Height can be measured orthogonally from a mounting interface of a board connector 110 to the highest point on the board connector that is parallel to the mounting interface.

Figure 32:
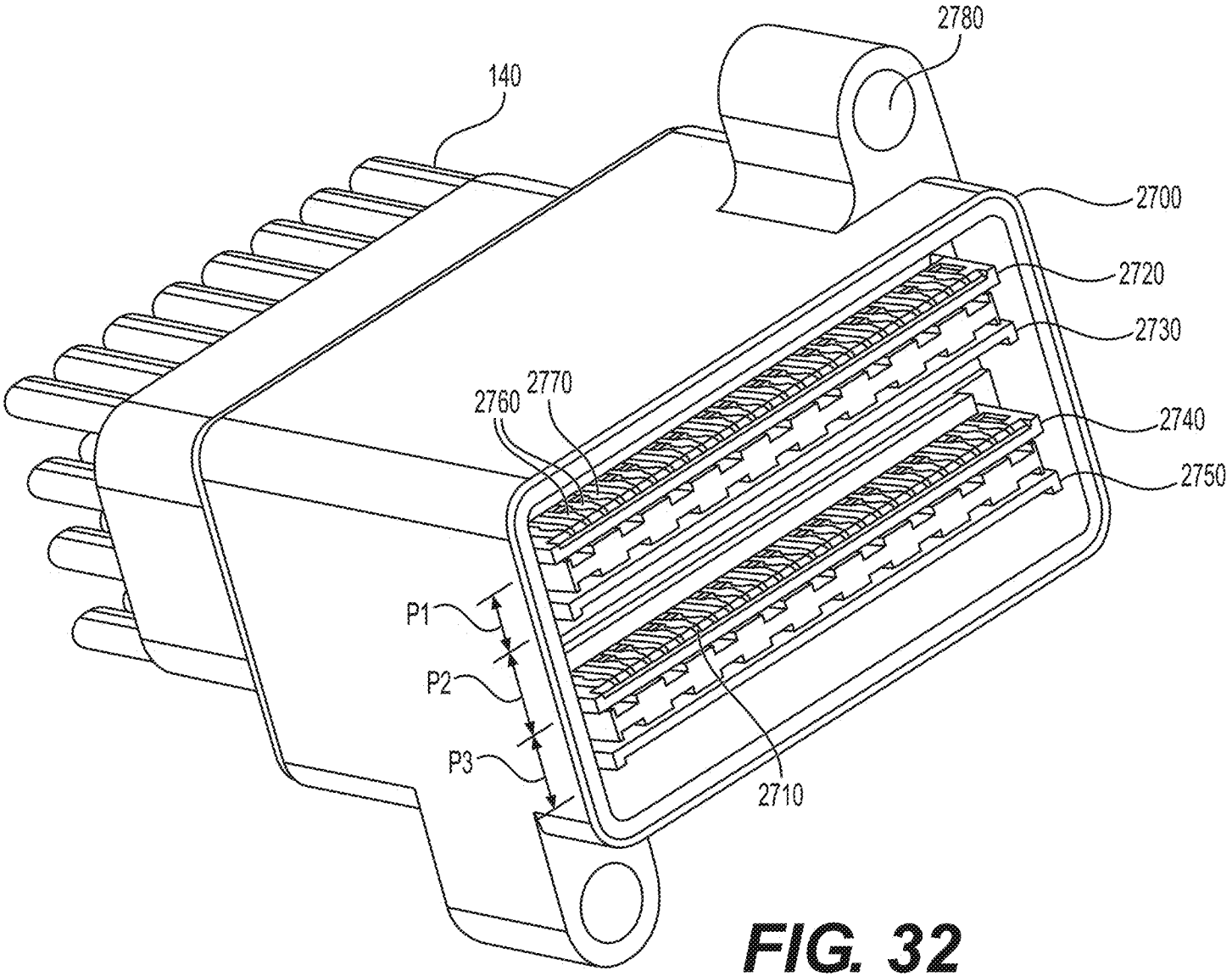
FIG. 32 is a perspective side view of a first electrical panel connector.

In total, on both the first and second surfaces of the die package, a die package in the range of approximately 140 mm by 140 mm to approximately 280 mm by 280 mm can carry at least 1024 twin axial pairs or 2048 individual cable conductors which are routed to respective first electrical panel connectors 2700, examples of which are shown in FIG. 32.

With combined reference to FIGS. 1, 23, and 32, cable 140 (shown in FIG. 1) can be attached at one end to a respective one of a first, second or third cable connector 120 (shown in FIG. 1), 130 (shown in FIG. 1), 2310 (shown in FIG. 23) and at an opposite end to a respective first electrical panel connector 2700 to form an electrical cable assembly. More specifically, differential signal pairs on an approximate 0.635±0.005 mm pitch carried by the cable can be attached at one end of respective differential signal pairs of one of the first, second, or third cable connectors and at an opposite end of differential signal pairs on an approximate 0.635±0.005 mm pitch carried by a first electrical panel connector.

As shown in FIG. 32, cable 140 can be shielded twin axial cables or individually shielded coaxial cables (not shown). Cable shields 144 (shown in FIG. 1) are optional. For example, each cable 140 can have a maximum outer diameter of 26-gauge, 27-gauge 28-gauge, 29-gauge, 30-gauge, 31-gauge, 32-gauge, 33-gauge, 34-gauge, 35-gauge, or 36-gauge. Each cable 140 can have a maximum diameter of about 2 mm to about 2.8 mm, within manufacturing tolerances. In one exemplary, non-limiting example, a cable assembly may include a first, a second, and/or a third cable connector 120 (shown in FIG. 1), 130 (shown in FIG. 1), 2310 (shown in FIG. 23) having a height approximately equal to 1.0±0.5 mm, a first electrical panel connector 2700, and a cable 140 electrically connected to both the first electrical panel connector 2700 and the first, the second, and/or the third cable connector 120 (shown in FIG. 1), 130 (shown in FIG. 1), 2310 (shown in FIG. 23). The cable 140 can have a maximum diameter of 34 or 35 or 36 gauge. Frequency domain NEXT crosstalk of the cable assembly can be between −40 dB to −60 dB through frequencies up to and including 30 GHz, 35 GHz, or 40 GHz or under −40 dB through frequencies up to and including approximately 30 GHz. Data rate is approximately equal to two times the frequency, so the cable assembly can pass approximately 60 Gbits/sec with under −40 dB of NEXT crosstalk. The first electrical panel connector 2700 can be configured not to receive an edge card.

As shown in FIG. 32, the first electrical panel connector 2700 can be a modified ACCELERATE I/O connector. Standard ACCELERATE connectors are commercially available from SAMTEC, Inc. A modified ACCELERATEC I/O can carry 34 AWG, 35 AWG, or 36 AWG cables. Cables with other gauges are also possible, including, for example, 26 AWG, 27 AWG, 28 AWG, 29 AWG, 30 AWG, 31 AWG, 32 AWG, and 33 AWG. A further modification is the addition of third and fourth rows 2740, 2750 of electrical conductors 2710. Instead of only a first row 2720 of electrical conductors 2710 and a second row 2730 of electrical conductors 2710, a third row 2740 and a fourth row 2750 of electrical conductors 2710 are added. Each of the first, second, third, and fourth row 2720, 2730, 2740, 2750 can include eight differential signal pairs 2760 and grounds 2770 arranged in a S-S-G or S-S-G-G configuration. A S-S-G-G configuration can reduce signal density. Additional modifications include spacing the first, second, third, and fourth rows 2720, 2730, 2740, 2750 of electrical conductors 2710 on 2.2 mm, 3 mm, and 2.2 mm pitches P1, P2, P3, with an approximate 3 mm space between the second and third rows 2730, 2740. First and second rows 2720, 2730 can be spaced apart by an approximate 2.2 mm first row pitch P1. Second and third rows 2730, 2740 can be spaced apart by an approximate 3 mm second row pitch P2. Third and fourth rows 2740, 2750 can be spaced apart by an approximate 2.2 mm third row pitch P3. Electrical conductors can be on a 0.635±0.05 mm pitch. One or more panel fastener receptacles 2780 can receive panel fasteners 2790 to affix the first electrical panel connector 2700 to a panel, such as the 1 RU panel shown in FIG. 33.

Figure 33:
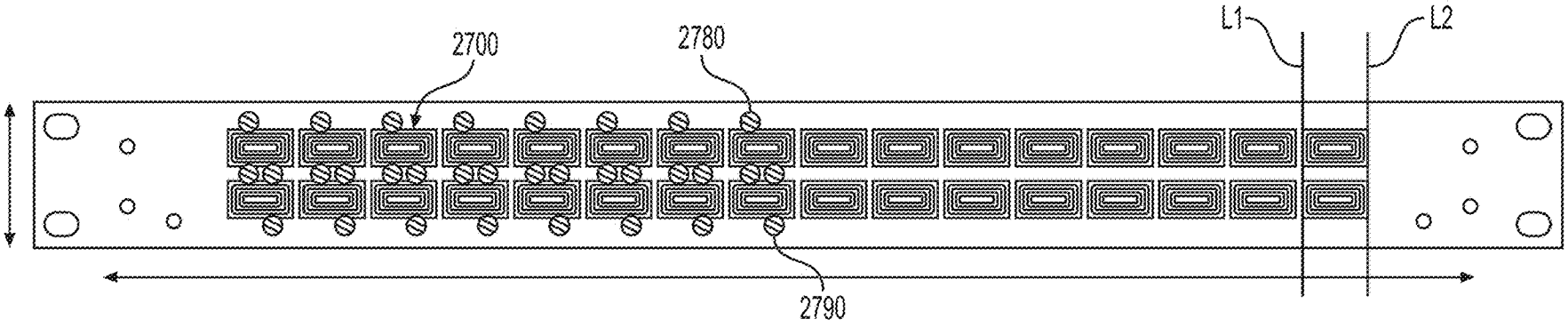
FIG. 33 is a front view of a 1 RU panel.

FIG. 33 shows a face of a 1 RU panel populated with first electrical panel connectors 2700. Panel fastener receptacles 2780 are reversed compared to FIG. 32. Thirty-two of the first electrical panel connectors 2700 can fit within the area of a 1 RU panel, which is approximately 1.75 inches by 19 inches, or approximately 29.75 inches$^2$, or approximately 214 cm$^2$. First electrical panel connectors 2700 can be vertically stacked such that two first electrical panel connectors 2700, which may have the same number of differential signal pairs, both fit between two spaced apart, parallel lines L1, L2 that both extend in the 1.75 inch direction of the 1 RU panel, with only two first electrical panel connectors 2700 positioned between the two spaced apart, parallel lines.

Worst case embodiments of the present invention can pass or fit at least 768 differential signal pairs through a 1 RU panel area of 42-mm-by-325-mm (approximately 143 cm$^2$), using approximately twenty-four first electrical panel connectors 2700 each carrying thirty-two differential signal pairs and at least 34 AWG cable 140, with a corresponding throughput of approximately at least 37 Tb/sec. Throughput is more than double the prior art throughput. The number of differential pairs attached to a 1 RU panel, via first electrical panel connectors 2700, is approximately 256 greater than compared to the prior art. At least 2048 individual cable conductors or 1024 differential twinax of at least 34 AWG cables can terminate to thirty-two or thirty-three of the first electrical panel connectors 2700, all within an area defined by approximately 1.75 inches by approximately 17 inches, or approximately 29.75 inches$^2$, or approximately 192 cm$^2$. Corresponding throughput is approximately 50 Tb/sec. t least 1536 individual cable conductors, or 768 twin axial cables, or 384 channels, can fit within a panel area of approximately 21 inches$^2$ to approximately 26 inches$^2$, or approximately 143 cm$^2$ to approximately 196 centimeters$^2$.

At least 513 differential signal pairs can fit within a panel area of 12.8 inches by 1.73 inches, or approximately 143 cm$^2$. At least 600 differential signal pairs can fit within a panel area of 12.8 inches by 1.73 inches, or approximately 143 cm$^2$. At least 700 differential signal pairs can fit within a panel area of 12.8 inches by 1.73 inches, or approximately 143 cm$^2$. At least 800 differential signal pairs can fit within a panel area of 12.8 inches by 1.73 inches, or approximately 149 cm$^2$. At least 900 differential signal pairs can fit within a panel area of 12.8 inches by 1.73 inches, or approximately 168 cm$^2$. At least 1000 differential signal pairs can fit within a panel area of 12.8 inches by 1.73 inches, or approximately 186 cm$^2$. Each of the first electrical or front panel connectors, alone or in combination, carry differential signals with a frequency domain crosstalk between −40 dB to −60 dB through frequencies up to and including 30 GHz, 35 GHz, or 40 GHz.

The number of cables or differential signal pairs that can fit within a 1 RU panel can be independent of the number of first electrical panel connectors 2700. 1024 differential signal pairs can fit within the area of a 1 RU panel, which is approximately 1.75 inches by 17 inches, or approximately 29.75 inches$^2$, or approximately 192 cm$^2$. At least 2048 individual cable conductors or 1024 differential twinax cables can terminate to or pass through an area defined by approximately 1.75 inches by approximately 17 inches, or approximately 29.75 inches$^2$, or approximately 192 cm$^2$. If the cable is reduced in diameter, thirty-two of the first electrical panel connectors 2700 can fit within a panel area of 14.75 inches by 1.75 inches, or approximately 25.8 inches$^2$, or approximately 166 cm$^2$. Thirty-two of the first electrical panel connectors 2700 can fit within a panel area of 14.75 inches by 1.5 inches, or approximately 22 inches$^2$, or approximately 142 cm$^2$.

At least 513 differential signal cable pairs can attach to respective first electrical panel connectors that take up no more than one half of 1 RU panel area, such as one half of approximately 19 inches by 1.75 inches, or one half of approximately 33 inches$^2$, or approximately one half of 213 cm$^2$.

Any area described herein is not limited to a single 1 RU panel. A panel area can be distributed among two or more 1 RU panels, as long as the combined area taken up by the at least 1024 twin axial, at least 2048 coaxial cables, or the connectors is equal to or less than the area of a single 1 RU panel. The 1 RU panel can define a plurality of panel through holes, like a screen, to permit airflow through the 1 RU panel.

Figure 34:
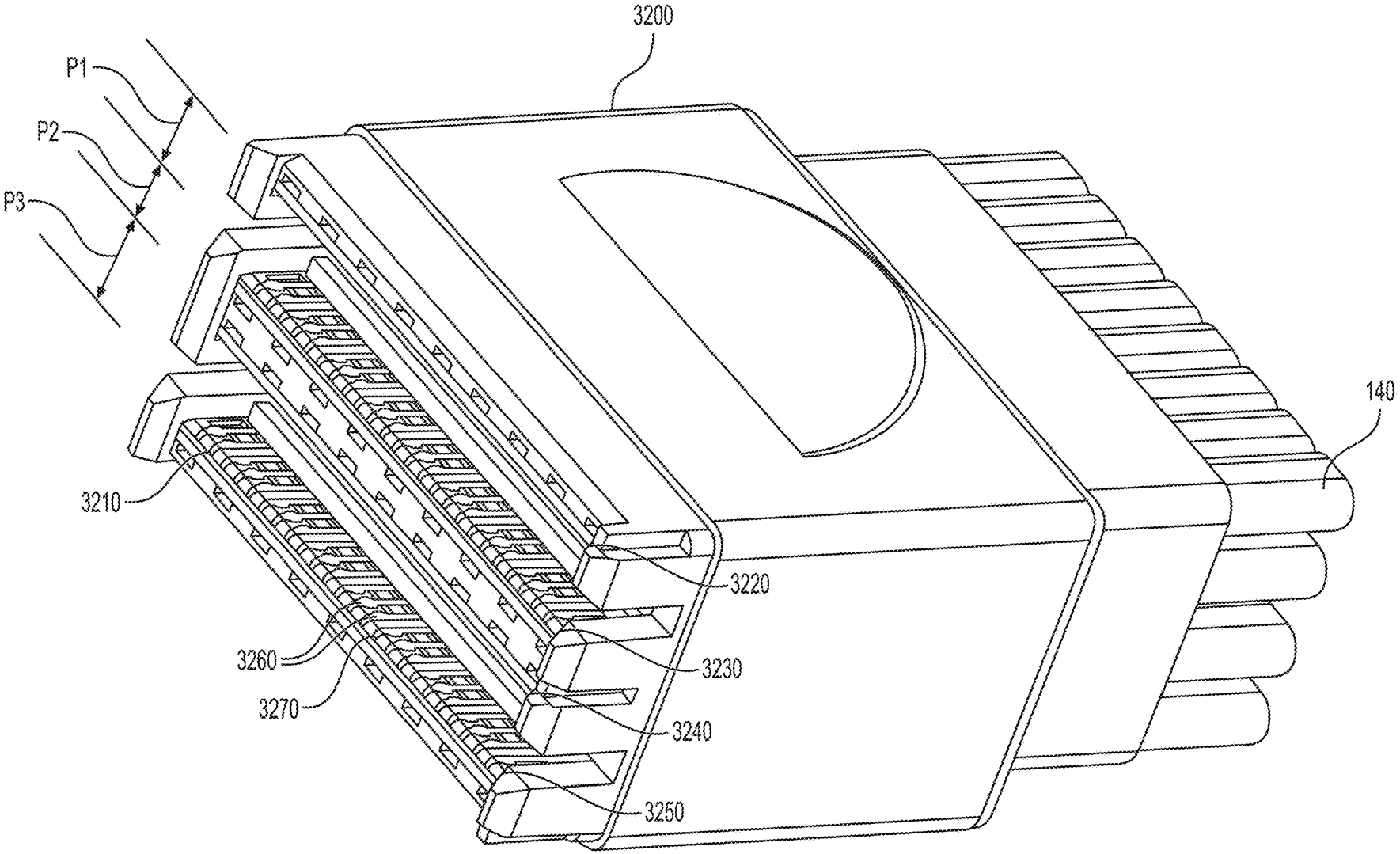
FIG. 34 is a perspective side view of a second electrical panel connector.

As shown in FIG. 34, an external cable connector 3200 can mate with a corresponding first electrical panel connector 2700. Like the first electrical panel connector 2700 (shown in FIG. 32), the external cable connector 3200 can be a modified ACCELERATE connector, commercially available from SAMTEC, Inc., and can carry 26 AWG, 27 AWG, 28 AWG, 29 AWG, or 30 AWG cables. Cables with other gauges can also be used, including, for example, 31 AWG, 32 AWG, 33 AWG, 34 AWG, 35 AWG, or 36 AWG. The external cable connector 3220 can have a first row 3220 of electrical conductors 3210, a second row of electrical conductors 3210, a third row of electrical conductors 3210, and a fourth row of electrical conductors 3250. The first and second rows can be on an approximate 2.2-mm first row pitch P1. The second and third rows can be on an approximate 3-mm second row pitch P2. The third and fourth rows 3240, 3250 can be on an approximate 2.2-mm third row pitch P3. The external cable connector 3200 can define an external cable mating interface that can include electrical conductors 3210, such as differential signal pairs 3260 and ground conductors 3270. The electrical conductors 3210 and the ground conductors 3270 can be overmolded and can be carried by individual overmolds. The electrical conductors 3210 can be arranged in a repeating S-S-G configuration, a repeating S-G-S configuration or a repeating S-S-G-G configuration. In a repeating S-S-G configuration, a conductor pitch between adjacent electrical conductors 3210 can be approximately 0.6 mm or 0.635±0.005 mm. A cable pitch between adjacent twin axial cables 140 can be approximately 2.4 mm.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims.

What is claimed is:

1. A cable connector comprising:

a first cable conductor that defines a first mating end;

a second cable conductor that defines a second mating end; and an insert that carries the first cable conductor and the second cable conductor, wherein the first mating end defines a first contact surface, the second mating end defines a second contact surface, the cable connector is a first connector, when the first connector is connected to a second connector, the first contact surface electrically and physically connects to and releasably attaches to a first head of a first cantilevered electrical contact in the second connector, and the second contact surface electrically and physically connects to and releasably attaches to a second head of a second cantilevered electrical contact in the second connector, the first cable conductor and the second cable conductor define a differential signal pair, a first centerline divides a cross-section of the first mating end of the first cable conductor into a first semicircle and a second semicircle, and the first semicircle is devoid of plastic and defines the first contact surface.

2. The cable connector of claim 1, wherein a second centerline divides a cross-section of the second mating end of the second cable conductor into a third semicircle and a fourth semicircle; and the fourth semicircle is devoid of plastic and the second and third semicircles are positioned between the first semicircle and the fourth semicircle.

3. The cable connector of claim 1, wherein a cross-section of the second mating end of the second cable conductor into a third semicircle and a fourth semicircle, and the third semicircle is devoid of plastic, the first contact surface faces away from the second semicircle, and the second contact surface faces away from the fourth semicircle.

4. The cable connector of claim 1, further comprising a dielectric layer that at least partially surrounds the first cable conductor and the second cable conductor.

5. The cable connector of claim 4, further comprising a cable shield that at least partially surrounds the dielectric layer.

6. The cable connector of claim 1, wherein a second centerline divides a cross-section of the second mating end of the second cable conductor into a third semicircle and a fourth semicircle; and the fourth semicircle is devoid of plastic and defines the second contact surface.

7. The cable connector of claim 6, wherein the first contact surface and the second contact surface face in opposite directions.

8. The cable connector of claim 1, wherein the first mating end is devoid of a cable shield.

9. The cable connector of claim 1, wherein the second mating end is devoid of a cable shield.

10. The cable connector of claim 1, wherein the first contact surface is only a single contact surface.

11. The cable connector of claim 1, wherein the second contact surface is only a single contact surface.

12. The cable connector of claim 1, further comprising a connector shield carried by the insert.

13. The cable connector of claim 12, wherein the connector shield defines a groove, and the groove is configured to receive a cable shield.

14. The cable connector of claim 12, wherein the connector shield defines a slot, and the slot is configured to receive a ground blade of a mating connector.

15. The cable connector of claim 1, wherein the insert defines a tooth, the tooth carries both the first cable conductor and the second cable conductor, and the first contact surface and the second contact surface face in opposite directions.

16. The cable connector of claim 15, wherein the tooth defines a base and a cross member positioned perpendicular to the base.

17. The cable connector of claim 15, wherein the tooth defines a base, and the insert defines a first hole and a second hole adjacent to the base.

18. The cable connector of claim 17, wherein the base defines a first base recess adjacent to the first hole, and the first hole and the first base recess receive the first mating end of the first cable conductor.

19. The cable connector of claim 18, wherein the base defines a second base recess adjacent to the second hole, and the second hole and the second base recess receive the second mating end of the second cable conductor.

20. The cable connector of claim 1, wherein the first cable conductor and the second cable conductor are part of a shielded, coextruded twin axial cable that has a gauge of 34 AWG to 36 AWG.

21. The cable connector of claim 1, wherein the first cable conductor and the second cable conductor are part of a shielded, co-extruded twin axial cable that has a gauge of 28 AWG to 30 AWG.

22. The cable connector of claim 1, wherein the cable connector is arranged to be nested within a mating connector when mated with the mating connector.

* * * * *